US008530122B2

(12) United States Patent
Uchino et al.

(10) Patent No.: US 8,530,122 B2
(45) Date of Patent: Sep. 10, 2013

(54) FOIL TRANSFERRING FACE FORMING TONER AND IMAGE FORMING METHOD

(75) Inventors: Yasuko Uchino, Tokyo (JP); Tatsuya Nagase, Tokyo (JP); Asao Matsushima, Tokyo (JP); Aya Shirai, Tokyo (JP); Ryuichi Hiramoto, Tokyo (JP); Michiyo Fujita, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 135 days.

(21) Appl. No.: 13/185,292

(22) Filed: Jul. 18, 2011

(65) Prior Publication Data

US 2012/0028175 A1 Feb. 2, 2012

(30) Foreign Application Priority Data

Jul. 30, 2010 (JP) ..... 2010-171434

(51) Int. Cl.
*G03G 13/04* (2006.01)
*G03G 13/08* (2006.01)

(52) U.S. Cl.
USPC ..... 430/48; 430/123.55; 430/256

(58) Field of Classification Search
USPC ..... 430/123.55, 256, 258, 262, 48
See application file for complete search history.

(56) References Cited

U.S. PATENT DOCUMENTS

| | | | | |
|---|---|---|---|---|
| 5,429,898 | A * | 7/1995 | Sugizaki et al. | 430/123.52 |
| 5,607,805 | A * | 3/1997 | Semura et al. | 430/109.4 |
| 6,223,799 | B1 * | 5/2001 | Johnstone | 156/542 |

FOREIGN PATENT DOCUMENTS

| | | |
|---|---|---|
| JP | 01-200985 | 8/1989 |
| JP | 09-001995 | 1/1997 |
| JP | 2000-127691 | 5/2000 |
| JP | 2007-015159 | 1/2007 |
| JP | 2009-090464 | 4/2009 |

* cited by examiner

*Primary Examiner* — Thorl Chea
(74) *Attorney, Agent, or Firm* — Lucas & Mercanti, LLP

(57) ABSTRACT

A method for forming an image at least comprising steps of forming an electrostatic latent image by exposing an electrophotographic photoreceptor, forming a foil transferring face by supplying a toner onto the electrophotographic photoreceptor having the electrostatic latent image, transferring the foil transferring face formed on the electrophotographic photoreceptor to a base substance, fixing the foil transferring face transferred on the base substance, supplying a transfer foil to the base substance fixed with the foil transferring face, adhering the transfer foil onto the foil transferring face by heating under a condition of contacting the transfer foil with the foil transferring face; and removing the transfer foil from the base substance while leaving the foil adhered onto the foil transferring face, wherein the toner comprises a binder resin having a softening temperature in the range of from not less than 105° C. to not more than 140° C., and having a molecular weight of not less than 60,000 in a ratio of not less than 10% and not more than 30% based on the total binder resin constituting the toner.

5 Claims, 6 Drawing Sheets

FOIL TRANSFERRING FACE FORMING TONER AND IMAGE FORMING METHOD

This application is based on Japanese Patent Application No. 2010-171434 filed on Jul. 30, 2010, in Japanese Patent Office, the entire content of which is hereby incorporated by reference.

TECHNICAL FIELD

The present invention relates to a foil transferring face forming toner (hereinafter simply referred to as toner) which is supplied at a portion of transferring the foil on a base substance and forms a layer called a foil transferring face and an image forming method which has a step for forming the foil transferring face by using the same.

BACKGROUND

In a field of bookbinding, a commercial printing, a card business or a plastic molding such as a cosmetic container, a printing processing treatment called "Foil stamping" is conducted. This treatment is also called "Hot stamp method" and by using a pressure bonding member called a metal stamper, a text or a picture made of a metallic foil is transferred to a base substance surface by heat and pressure, a metallic appearance or an expensive look can be achieved which cannot be expressed merely by common printing. Further, in recent years, a hologram is often attached on, for example, a cash card or a credit card in order to prevent falsification or alteration, or for the security of these cards. Such a hologram used for the prevention of falsification of a card has been formed mainly by employing a technique of foil transferring.

In a transfer foil used for the foil stamping, for example, a protective layer, a transfer material layer and an adhesive layer are provided on a release agent layer formed on a plastic support made of such as a polyester film, in which the transfer material layer is formed by vacuum evaporation or by using an ink. The technique to produce a transfer foil has been improved in accordance with the enlargement of the market of the transfer foil. For example, researches on a transfer foil having a protective layer containing an organic silicon compound and a reactive organic compound in view of improving the durability of a foil image, and on a transfer foil having an electron beam curable adhesive layer by which a stronger protective layer is formed by being irradiated with an electron beam after peeled from the support, have been brought forward (for example, refer to Patent Documents 1 and 2). Since many of these transfer images used for the prevention of falsification or for security of the cards contain a precise pattern, it is required to accurately transfer the image but not to cause a problem such as a burr or missing of the foil. In accordance with such a requirement, there has been examined a transfer foil by which, by incorporating a polymer liquid crystal material in a transfer layer, a precise-shaped label is accurately transferred without causing defects such as buns or missing of the foil (for example, refer to Patent Documents 3).

On the other hand, in order to conduct foil transfer on a base substance with a simple process, advanced has been a technique to form a resin layer on the surface of a base substance and to provide a transfer foil on the resin layer. Because synergistic effect can be obtained between an adhesive force formed by softening or melting of toner and an adhesive force formed by melting of an adhesive layer of a transfer foil via heating, this technology can realize a strong adhesion between a base substance and a foil. Specifically, a convexes image or a design image is formed on a base substance by using toner, followed by heat-pressing a transfer foil onto the formed toner image, resulting in transferring a foil (for example, refer to Patent Document 4).

Further, there is a technique for transferring a metal foil on a base substance in which a toner is preliminary adhered on a base substance, provided thereon an evaporated foil sheet, hot pressed by an iron, followed by peeling the evaporated foil sheet from the base substance (for example, refer to Patent Document 5). In these foil transfer technique which uses toner, the foil transfer can be carried out without using a metal pressing member called a press required in the conventional technique, resulting in reducing necessary time for a foil transfer process or simplifying an apparatus of a foil transfer.

PRIOR ART DOCUMENTS

Patent Documents

[Patent Document 1] Unexamined Japanese Patent Application Publication (hereinafter referred to as JP-A) No. 9-1995

[Patent Document 2] JP-A No. 2007-15159

[Patent Document 3] JP-A No. 2009-90464

[Patent Document 4] JP-A No. 1-200985

[Patent Document 5] JP-A No. 2000-127691

SUMMARY OF THE INVENTION

In some cases, a heat treatment is added on the base substance with the transferred foil after transferring a foil onto a base substance. Specifically, there is a case of so-called "overprinting" in which an image is formed on the base substance with the transferred foil by using toner, followed by fixing the transferred toner image or a case called "re-transferring a foil" in which a heat treatment for forming an overprint image is carried out by transferring another foil onto the formed foil image.

Thus, when the heat treatment such as "overprinting" or "re-transferring a foil" is carried out onto the base substance with transferred foil, this heat treatment may cause micro cracks (hereinafter, referred to as "stripe", because they look like stripe) on the foil parallel to a direction of an axis of a fixing roll, resulting in bad finish and the bad finish of foil largely influences quality of products. It is realized that the repeated heat treatments causes increasing toner flow and by adding an external force such as pressure in this state, foil is broken or slipped on the foil transferring face forming toner, resulting in these micro cracks (stripe).

In the case of forming further image onto the base substance with transferred foil by toner, studied is a method other than an electrophotographic system such as an inkjet or an offset printing. However, these are not preferable because base substance material is limited and process becomes complex.

Thus, required is a foil transferring face forming toner which is applicable for forming further image onto the base substance with transferred foil by toner and also has excellent heat resistance. However, it is difficult to find a technique to resolve it. An object of the present invention is to provide a foil transferring face forming toner which forms toner layer on the base substance and forms thereon a foil transferring face to which a foil is transferred. Specifically, an object is to provide a heat stable foil transferring face forming toner which does not causes any deformation such as stripe on the foil and keeps good finish, even when heat treatment is carried out such as the case of further toner image formation on the base substance with transferred foil on the formed foil transferring face.

Further, an object is to provide a method for forming a heat stable foil image which can form a foil transferring face and does not causes any deformation such as stripes. For example, an object is to provide a method for forming excellent foil image having good finish without any deformation such as stripe by heating, even when toner image is formed on the base substance with transferred foil. In the present invention, a layer which is formed by a toner at a portion of transferring foil on a base substance and adhere a foil to a base substance is referred to as "foil transferring face". Also, the toner which is utilized for forming the foil transferring face is referred to as "toner for forming foil transferring face".

In view of the foregoing, the inventors of the present invention conducted diligent investigations. The above object has been attained by either constitution described below:

1. A method for forming an image comprising steps of forming an electrostatic latent image by exposing an electrophotographic photoreceptor, forming a foil transferring face by supplying a toner onto the electrophotographic photoreceptor having the electrostatic latent image, transferring the foil transferring face formed on the electrophotographic photoreceptor onto a base substance, fixing the foil transferring face transferred on the'base substance, supplying a transfer foil to the base substance having the fixed foil transferring face, and adhering the transfer foil onto the foil transferring face by healing under a condition of contacting the transfer foil with the foil transferring face; and removing the transfer foil from the base substance while leaving the foil adhered onto the foil transferring face, wherein a toner which is used to form the foil transferring face comprises a binder resin having a softening temperature in the range of from not less than 105° C. to not more than 140° C. determined by a Flow tester method, and having a molecular weight of not less than 60,000 in a ratio of not less than 10% and not more than 30% based on the total binder resin constituting the toner determined by a gel permission chromatography method.

2. The method for forming an image of item 1 comprising a step of heating the base substance having the transferred foil on the foil transferring face.
3. The method for forming an image of item 2 comprising steps of forming a toner image onto the base substance having the transferred foil on the foil transferring face, and fixing the toner image by heating the base substance having the toner image.
4. The method for forming an image of any one of items 1 to 3, wherein the binder resin at least comprises a copolymer formed by polymerizing monomers of styrene, n-butyl acrylate and methacrylic acid.

By employing toner specifying a softening temperature and a content ratio of binder resin having molecular weight 60,000 or more, the present invention can achieve to provide a heat stable foil transferring face forming toner. Namely, a heat stable foil transferring face forming toner can be achieved which does not causes any deformation such as stripe on the foil and keeps good finish, even when heat treatment for fixation is carried out.

Further, in case of an image formation by employing the above toner, a product having good finished foil can be available without affecting to a finished quality of a foil, even when fixation is carried out such as the case of further toner image formation on the base substance with transferred foil. Thus, according to the present invention, by employing the above toner, it is possible to form a heat stable and excellent finished foil image, even when an image formation process comprises a step of heating a base substance with transferred foil. Further, when a toner image is formed onto a base substance with transferred foil, a smooth continuous printing can be carried out without a conveying trouble due to a peel of foil on a foil transferring face.

DESCRIPTION OF THE PREFERRED EMBODIMENT

Figure 1A:
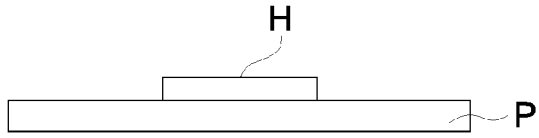
FIG. 1*a*-1*e* are schematic diagrams each of which shows a procedure to transfer a foil onto a foil transferring face formed on a base substance.

The present invention relates to a foil transferring face forming toner (hereinafter simply referred to as toner) which contributes to enhance an aesthetic aspect of a product by forming a layer called "foil transferring face" at a portion of transferring foil on a base substance and transferring a foil to the layer and an image forming method.

The toner related to the present invention at least comprises a binder resin having a softening temperature of not less than 105° C. and not more than 140° C., and a molecular weight of not less than 60,000 in a ratio of not less than 10% and not more than 30%.

The inventor considers that a foil transferring face forming toner requires property of adhering foil strongly during transfer, and after transfer, requires keeping adhesion force of foil without changing even when applying heat. Namely, the inventor considers a method in which a toner is completely melted and adhere a foil strongly when a foil is transferred, and the foil adhered to a toner layer does not fall oft even when the toner layer (foil transferring face) is melted by applying heat after transferring a foil.

The inventor examines the cause of falling off of foil from toner layer in case of heating after transferring a foil and presumes that toner layer becomes deformed by the influence of heating and a contact area between foil and toner layer is reduced due to deformation of toner layer. This is presumed by observing a stripe on a foil which generates after heating. From this, it is considered that the toner layer becomes deformed by fluidizing by heat, resulting in reducing a contact area between foil and toner layer and that foil which looses contact surface with toner layer cannot adhere to toner layer, resulting in sticking foils to each other and generating stripe.

In view of the foregoing, the inventors of the present invention conducted diligent investigation to give softness to toner to the extent of properly melting and also to the extent of preventing a fluidization such as a deformation of a toner layer when heating and to specify a softening temperature range which achieves these properties. As a result, discovered was that toner having above properties can be provided by controlling a softening temperature at not less than 105° C. and not more than 140° C.

Further, the inventors of the present invention conducted investigation to enhance a cohesive force between molecules of resin constituting a binder resin of toner by activating entanglements of molecular chains, for the purpose of preventing a deformation of toner layer when it is affected by stress such as heat. The inventors attempted to realize above by specifying a ratio of a component having high molecular weight which is advantageous to form entanglements of molecular chains. As a result, discovered was that when a toner comprises a binder resin having a molecular weight of not less than 60,000 in a ratio of not less than 10% and not more than 30% based on the total binder resin constituting the toner, the toner had a melting property to strongly adhere foil without deforming a toner layer when heat was applied.

The inventors of the present invention found that, for a foil transferring face forming toner which forms a foil image by transferring a foil on toner, it is necessary to balance two competing properties for melting property to strongly adhere foil and heat stability without deforming a toner layer by fluidizing when heat was added. The inventors found that the balance between these two competing properties can be achieved by specifying the range of softening temperature of toner and the ratio of a component having high molecular weight.

In the present invention, a foil transferring face forming toner comprises a binder resin having a molecular weight of not less than 60,000 in a ratio of not less than 10% and not more than 30% based on the total binder resin constituting the toner. The reason for focusing to the ratio of a resin component having a molecular weight of not less than 60,000 is based on a finding that in a toner having a high molecular weight component such as a weight average molecular weight exceeding 100,000 or 200,000, a ratio of a component having a molecular weight of not less than 60,000 tends to be remarkably increased.

On the other hand, it is empirically observed that the toner described above without having a high molecular weight component such as the toner comprising resin particles having a weight average molecular weight of 20,000 tends to contain little component having a molecular weight of not less than 60,000. Based on these findings, the toner of the present invention comprises a binder resin having a high molecular weight, and for quantitatively defining, the ratio of a resin component having a molecular weight of not less than 60,000 is specified.

The present invention will now be detailed.

The "foil transferring face forming toner"' as mentioned in the present invention refers to a resin powder used for forming a portion on which a foil is formed, when a foil is formed on a base substance of an image support to form an image or of a plastic molding, for example, an ID card. The foil transferring face forming toner is used to improve or maintain the adhesive property of a transfer foil on the base substance through a toner layer formed on the base substance. Specifically, at first, the toner of the present invention is supplied to a photoreceptor on which an electrostatic latent image is formed, the electrostatic latent image having the same shape as the shape of foil which is to be formed on a base substance, whereby a toner layer (a foil transferring face) for transferring a foil on the base substance is formed. The toner layer formed on the photoreceptor is transferred onto a base substance, followed by conducting a fixing treatment by heating. Next, a transfer foil is supplied onto the base substance having the fixed toner layer to adhere a foil on the toner layer by conducting a heat treatment while the transfer foil is in contact with the base substance. And, when the toner foil is removed while leaving a portion adhered onto the foil transferring face, a foil is transferred on the toner layer, whereby a pattern of a foil is formed on a base substance.

As described above, "the foil transferring face forming toner" as mentioned in the present invention is used to be supplied to a photoreceptor to form a toner layer called as "a foil transferring face". The foil transferring face formed with the foil transferring face forming toner of the present invention on the photoreceptor is then transferred onto a sheet like base substance, typically an image support, followed by fixing. Further, when a transfer foil is supplied on the foil transferring face fixed on the base substance and then heated, the foil is firmly adhered onto the foil transferring face. Thus, foil transfer is carried out.

"The foil transferring face" as mentioned in the present invention is an area on a base substance such as an image support or a plastic molding, on which a foil is transferred.

In the present invention, the terms "product" and "base substance" are used Either of them is constituted of a support called an image support on which image forming via a well-known image forming method is capable. Here, the "product" as mentioned in the present invention refers to a support decorated with a foil formed by at least transferring a foil on a base substance, and the "base substance" as mentioned in the present invention refers to an image support constituted of a base material such as paper or PET (polyethylene telephthalate) or a substance having a three-dimensional shape, for example, a plastic molding. Further, in the present invention, a substance, in which the foil transferring face is formed or the foil is transferred but before available to user is also referred to as "base substance".

Furthermore, the "foil" as mentioned in the present invention is also referred to as "transfer foil", and refers to a material obtained by rolling a metal into a thin film to be capable of adhering onto a base substance, which is used to provide a text image or a picture image having a metallic or glossy appearance which is difficult to be provided via a normal printing.

The present invention relates to a technology in which a product is prepared by heating a base substance transferred thereon a foil. Specific example for heating a base substance having a transferred a foil on a toner layer, namely a foil transferring face includes followings: At first, "overprinting" in which in addition to the foil image, other image is formed on the base substance by using toner. By using "overprinting", a full color image or mono tone image can be printed on the base substance in addition to the foil image. As described above, in view of preparing a product having excellent design by improving an aesthetic aspect, required was a technology in which a base substance can be heated without affecting a finish quality of foil image after transferring the foil.

Further, specific example includes "re-transfer of foil" in which transferred is a foil having different gloss or color from the foil used at first onto a base substance having already formed foil image. "Re-transfer of foil" is referred to as one of the embodiment of above "overprinting" in which a toner layer is formed by supplying a toner for transferring foil again on the base substance having already formed foil image, transferred thereon a foil having different gloss or color from the foil at first use. By "re-transfer of foil", a plurality kind of foil images can be formed on the base substance, resulting in enhancing an aesthetic aspect of a product.

Further, "Two steps fixation" in which a toner layer adhered to a foil is heated and melted again, in view of enhancing an adhesion force of the transferred foil to the base substance. By applying a plurality of fixation such as "Two steps fixation", an adhesion force between a toner layer and a transferred foil can be enhanced, resulting in enhancing durability of the foil image formed on the base substance surface. Herein, required is a technology which can form a toner layer without occurring a stripe or a wrinkle on the foil, even after heating and melting a toner layer a plurality times.

The foil transferring face forming toner of the present invention will now be described. The foil transferring face forming toner of the present invention has a softening temperature not less than 105° C. and not more than 140° C., and comprises a binder resin having a molecular weight of not less than 60,000 in a ratio of not less than 10% and not more than 30% based on the total binder resin constituting the toner. According to the present invention, by using specified toner having the softening temperature and the ratio of a resin component having a molecular weight of not less than 60,000, the excellent foil image having finish quality without occurring a stripe on the foil image can be formed even heating a base substance having transferred foil.

The foil transferring face forming toner of the present invention has a softening temperature not less than 105° C. and not more than 140° C. The softening temperature in above range results in melting property which can adhere a foil tightly to a foil transferring face and prevent from deforming toner layer for forming a foil transferring face, thereby prevent from occurring image defect such as stripe on the foil image, even heating a base substance having transferred foil. Namely, the inventors of the present invention found that the softening temperature in above range realizes a proper softening property to an adhesion of transfer foil and also heat to the extent for giving above softening property does not cause a strain for deforming a toner layer.

Therefore, in case of a softening temperature of foil transferring face forming toner being less than 105° C., a melting property for adhering foil tightly can be obtained but toner layer tends to be deformed easily, thereby image defects such as stripe tend to occur when heating a base substance having transferred foil. On the other hand, in case of a softening temperature of foil transferring face forming toner being more than 140° C., a melting property for adhesion of foil cannot be obtained, thereby foil cannot be transferred onto the foil transferring face. Therefore, preferable temperature in a range for a fixing of foil transferring face forming toner is from 110° C. to 210° C. and for a fixing of foil transferring face forming toner is from 110° C. to 210° C. Thus, with respect to the foil transferring face forming toner, the inventors of the present invention found the temperature range which can balance softening property for strong adhesion of foil and heat stability without deforming a toner layer.

The softening temperature related to the present invention can be determined and calculated by a conventional measuring method such as Flow tester method. The softening temperature can be determined by Flow tester method in the following manner.

(1) Preparation of Sample

Under an environment of 20±1° C. and 50±5% RH, 1.1 g of a toner is placed into a petri dish and leveled off. After being allowed to stand for at least 12 hours, they are compressed for 30 seconds under a force of $3.75\times10^8$ Pa (3,820 kg/cm$^2$) using a molding device SSP-A (produced by Shimazu Seisakusho) to prepare a cylindrical molded sample of a 1 cm diameter.

(2) Measurement of Softening Temperature

Under an environment of 24±5° C. and 50±20% RH, above molded sample was set in a flow tester CFT-500D (produced by Shimazu Seisakusho). Then, the prepared sample was extruded through a hole of a cylindrical die (1 mm×1 mm) using a piston of 1 cm diameter after completion of pre-heating under conditions of a load weight of 196 N (29 kgf), at an initial temperature of 60° C., a pre-heating time of 300 seconds and temperature-raising rate of 6° C/minute. Herein, extrusion began after finishing pre-heating. An offset method temperature ($T_{offset}$), which is determined by a melting temperature measurement method (temperature-raising method) at an offset value of 5 mm, is defined as the softening point of a toner.

The binder resin related to the invention has a molecular weight of not less than 60,000 in a ratio of not less than 10% and not more than 30%. Thus, by containing specific amount of binder resin having a molecular weight of not less than 60,000 in the binder resin, adhesive force can be enhanced due to enhancement of molecular chain entanglement and cohesive force between molecular chains. Further, by enhancement of molecular chain entanglement, melting property of toner can be controlled, thereby the toner layer having transferred foil tends to become less deformed by heating.

Therefore, in case of toner having a molecular weight of not less than 60,000 in a ratio of less than 10%, when heat treatment is carried out after foil transfer, enough intermolecular cohesive force cannot be obtained, thereby a transferred foil transferring face tends to cause a finish defect such as stripe on the foil or peel-off of a foil. Namely, since an entanglement between resin molecules is not realized enough and a cohesive force between molecules constituting binder resin is week, an enough adhesive force to fix a transferred foil unable to be obtained, resulting in causing melting and deformation easily by heating. Further, in case of toner having a molecular weight of not less than 60,000 in a ratio of exceeding 30%, an intermolecular cohesive force of binder resin is too strong, thereby higher heating temperature has to be set for forming a foil transferring face. However, even though a foil transferring face can be formed, it is difficult to melt the formed foil transferring face and also extremely difficult to achieve uniform adhesion of foil.

A conventional measurement method of a molecular weight can be applicable for a measurement method of a molecular weight of binder resin constituting toner of the present invention without being restricted thereto, provided that a molecular weight distribution can be determined. Namely, a method in which a mass ratio of molecular weight based on total resin can be determined and calculated by quantifying a difference of physical property such as solubility caused by a slight difference between a molecular weight can be applicable, without being restricted thereto. Specifically, listed are methods such as gel permeation chromatography (hereinafter, referred to as GPC method), light scattering method, X-ray small angle scattering method. Of these, gel permeation chromatography (GPC method) is preferable, in view that it detects toner particle directly, and a molecular weight distribution of the binder resin can be calculated by operation procedure such as computer from measured values and enables to have quantitative results easily and with a high accuracy comparing to the other methods. Determination procedure of molecular weight by gel permeation chromatography will now be described.

First, a toner particle is dissolved in tetrahydrofuran (THF) at room temperature, while being stirred over 5 min. by an ultrasonic homogenizer to obtain a solution at a concentration of 1 mg/ml. Subsequently, the solution is filtered with a membrane filter having a pore size of 0.2 μm to obtain a sample solution. Into the apparatus was injected 10 μl of the obtained sample solution.

The gel permeation chromatography method can be measured in the following condition.

Apparatus: HLC-8020 (produced by TOSO Co., Ltd.)

Column: TSK guard column+TSK gel Super HZM-M, three-stranded (produced by TOSO Co., Ltd.)

Column temperature: 40° C.

Solvent: Tetrahydrofuran

Effluent rate: 0.2 ml/min.

Detector. Refractive index detector (RI detector)

The molecular weight of a sample is represented by a molecular weight in terms of styrene resin conversion. The molecular weight in terms of styrene resin conversion is determined by a styrene calibration curve. About 10 points of monodisperse polystyrene standard polystyrene may be measured to prepare a styrene calibration curve. A ratio of resin component having a molecular weight of not less than 60,000 based on a foil transferring face forming toner can be determined by using an integral molecular weight distribution curve.

A toner having a softening temperature being not less than 105° C. and not more than 140° C., and comprising a binder resin having a molecular weight of not less than 60,000 in a ratio of not less than 10% and not more than 30% can be prepared by controlling a reaction condition for polymerization of a binder resin by conventional method. For example, when a toner is prepared by an emulsion polymerization aggregation method in which resin particles are prepared through multi-step polymerization and mother toner particles are prepared by aggregation-fusion, toner having above constitution can be obtained by controlling a content of various compounds used in toner preparation. Namely, a softening temperature can be controlled by controlling a content of compound such as polymerizable monomer, polymerization initiator or chain transfer agent in case of resin particle preparation through multi-step polymerization, or aggregation agent in case of aggregating resin fine particles. Further, a ratio of resin component having a molecular weight of not less than 60,000 can be controlled by controlling a content of compound such as polymerizable monomer, polymerization initiator or chain transfer agent.

Further, since resin fine particle is prepared by using a plurality kind of polymerizable monomers in a preparation of toners, a method which includes controlling a ratio of polymerizable monomer composition is also employable. Further, since resin fine particle is prepared by polymerization reaction of polymerizable monomers, other method which includes controlling the temperature or time for polymerization reaction.

For example, in Example described later, in case of preparing toner particles by an emulsion polymerization aggregation method using styrene, n-butyl acrylate and methacrylic acid, prepared is toner in the above range of softening temperature and a ratio of molecular weight of not less than 60,000 through following three steps:

(1) in preparation of resin particles by multi-step polymerization, controlling contents of core resin fine particles used in the second step polymerization (resin fine particles prepared in the first step polymerization) and a chain transfer agent n-octyl mercaptane, (2) in preparation of resin particles by multi-step polymerization, controlling contents of polymerizable monomers (styrene, n-butyl acrylate and methacrylic acid) used in the third step polymerization, (3) in aggregating step of resin fine particles, controlling a content of magnecium chloride as aggregation agent.

Subsequently, resin constituting the toner related to the present invention will be described. Conventional resins for toner are applicable for the species of the resin used in the toner related to the present invention without limitation, provided that it has a softening temperature not less than 105° C. and not more than 140° C. and comprises a binder resin having a molecular weight of not less than 60,000 in a ratio of not less than 10% and not more than 30%. Of these, preferable is a resin formed by using vinyl based polymerizable monomer, such as copolymer resin formed by using styrene based monomer or (meth)acrylic acid based monomer.

Herein, "styrene based monomer" means a vinyl monomer having a benzene ring as a functional group in a molecular structure, which includes styrene derivatives other than styrene having various functional groups such as hydrocarbon group as methyl group or phenyl group, or halogen group bonded to the benzene ring. "(Meth)acrylic acid based monomer" means a vinyl monomer having either a carboxyl group (—COOH) or a carbonate ester (—COOR) as a functional group in a molecular structure.

"(Meth)acryl" means that monomer structure is either methacryl group ($CH_2{=}C(CH_3)COO$—) or acry group ($CH_2{=}CHCOO$—) and is classified "methacrylic acid based monomer" and "acrylic acid based monomer". Specific example of "methacrylic acid based monomer" includes methacrylic acid ($CH_2{=}C(CH_3)COOH$) and methacrylic acid ester derivatives listed below. Specific example of "acrylic acid based monomer" includes acrylic acid ($CH_2{=}CHCOOH$) and acrylic acid ester derivatives listed below.

According to the present invention, styrene is preferable among styrene based monomer and n-butyl acrylate and methacrylic acid are preferable among (meth)acrylic acid based monomer. As Example described later, specifically preferred is a vinyl copolymer resin formed by using styrene, n-butyl acrylate and methacrylic acid having a softening temperature and a ratio of molecular weight of not less than 60,000 in above range.

Specific examples of the vinyl type polymerizable monomer used for the toner related to the present invention are listed below, however the present invention is not limited thereto.

(1) Styrene Based Monomer (Styrene or Styrene Derivatives)

Styrene, o-methylstyrene, m-methylstyrene, p-methyl styrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene and p-n-dodecylstyrene;

(2) Methacrylate Based Monomer (Methacrylic Acid or Methacrylate Derivatives)

Methacrylic acid, methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate;

(3) Acrylic Acid Based Monomer (Acrylic Acid or Acrylic acd Ester Derivatives)

Acrylic acid, methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate and phenyl acrylate.

Further, following vinyl polymerizable monomer may be used for forming a binder resin in combination with above styrene based monomer and (meth)acrylic acid based monomer.

(4) Olefins

Ethylene, propylene and isobutylene;

(5) Vinyl Esters

Vinyl propionate, vinyl acetate and vinyl benzoate;

(6) Vinyl Ethers

Vinyl methyl ether and vinyl ethyl ether, (7) Vinyl Ketones

Vinyl methyl ketone, vinyl ethyl ketone and vinyl hexyl ketone;

(8) N-Vinyl Compounds

N-vinylcarbazole, N-vinylindole and N-vinylpyrrolidone; and (9) Others

Vinyl compounds such as vinylnaphthalene and vinylpyridine, acrylic or methacrylic derivatives such as acrylonitrile, methacrylonitrile, and acrylamide.

Further, it is possible to prepare resins having a cross-linking structure by employing polyfunctional vinyls. Listed below are specific examples of polyfunctional vinyls:

ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol methacrylate, and neopentyl glycol diacrylate.

A preparation method of the foil transferring face forming toner according to the present invention will now be described.

Any preparation method of the foil transferring face forming toner in relation to this invention are applicable without limitation, provided that it has a softening temperature not less than 105° C. and not more than 140° C. and comprises a binder resin having a molecular weight of not less than 60,000 in a ratio of not less than 10% and not more than 30%. Namely, the manufacturing method of the conventional toner used for an image forming method of the electrophotography can be applied to the manufacturing method of the foil transferring face forming toner. Such toner manufacturing methods can applicable as a pulverization method in which the toner is manufactured by processes of kneading, pulverization and classifying, and a polymerization method in which polymerizable monomers are polymerized and simultaneously particles are formed while particle shape and particle size are controlled.

Of these, the polymerization method is easy to obtain characteristics of uniform particle size distribution, sharp charge distribution and so on. The toner manufacturing method by polymerization includes a process forming resin particles by polymerization reaction such as suspension polymerization or emulsion polymerization. Of these polymerization methods, it is particularly preferable to manufacture including association process in which resin particles such as 100 nm size prepared by polymerization reaction are subjected to coagulation and fusion.

A manufacturing method of the transparent toner by emulsion association method is described as an example, in which toner mother particles are prepared comprising steps of preparing resin fine particles by emulsion polymerization and subjecting to coagulation and fusion. The manufacturing method of the foil transferring face forming toner by emulsion association method is conducted, for example, by the following processes.

(1) Process of preparation of dispersion liquid of resin microparticles (2) Process of coagulation and fusion of the resin microparticles (Process of association)

(3) Process of ripening (4) Process of cooling (5) Process of washing (6) Process of drying (7) Process of adding an external additive Each process is described below.

(1) Process of Preparation of Dispersion Liquid of Resin Microparticles

Binder resin for constituting foil transferring face forming toner is formed in this process. For example, at least vinyl polymerizable monomer is added and dispersed in an aqueous medium, vinyl polymerizable monomer is subjected to polymerization in this state to form resin microparticles having particle size of about 100 nm.

In this process, at first, by adding above vinyl polymerized monomer into aqueous medium and by emulsion dispersing treatment, formed is an aqueous medium having dispersed oil droplets of vinyl polymerized monomer. In the droplets dispersed in the aqueous medium, radical polymerization reaction proceeds to form resin microparticles.

In this process, it enables to add a toner constituting material such as wax other than vinyl polymerizable monomer used to polymerization reaction into an aqueous medium, to form droplets of polymerizable monomer having dissolved constituting material such as wax by dispersing, and to carry out radical polymerization thereof. By radical polymerization of these oil droplets, resin microparticles containing a toner constituting material such as wax can be prepared.

The radical polymerization process is a process to incorporate a polymerization initiator into droplets, to generate radicals by heat or light, to initiate polymerization reaction of vinyl polymerizable monomer by this radical and to form the resin microparticles by proceeding chain polymerization reaction. Or polymerization reaction can be initiated by supplying radicals generated from the polymerization initiator added in the aqueous medium into oil droplets by known method in other way.

Temperature at the radical polymerization, which varies depending on the kinds of vinyl polymerizable monomer or polymerizing initiator generating radicals, is preferably 50 to 100° C., and more preferably 55 to 90° C. Time for polymerization, which varies depending on the kinds of vinyl polymerizable monomer or reaction rate of radicals, is preferably 2 to 12 hours.

Oil droplets of the monomers are formed by that the vinyl polymerizable monomer is added and dispersed in an aqueous medium and these are subjected to dispersion process via an activity of mechanical energy. Dispersion apparatus in which oil droplets dispersion is carried out via application of mechanical energy are not particularly limited, but examples thereof include "CLEARMIX" (produced by M Technique Co., Ltd) with high speed rotating rotors. Agitating apparatus other than above, dispersion apparatus includes ultrasonic homogenizers, mechanical homogenizers, Manton-Gaulin, and pressure system homogenizers. By using these dispersion apparatus, the dispersed particles having diameter about 100 nm are formed in the aqueous medium.

The "aqueous medium" refers to a liquid comprising water and water-soluble organic solvent and containing water in an amount of at least 50% by mass. As "water-soluble organic solvents", examples thereof include methanol, ethanol, isopropanol, butanol, acetone, methyl ethyl ketone and tetrahydrofuran. Of these solvents, it is preferred to use alcoholic organic solvents such as methanol, ethanol, isopropanol and butanol which do not dissolve a resin.

(Multi-step Polymerization Process)

Since resin microparticles for constituting toner related to the present invention has a certain amount of molecular weight distribution, a plural of polymerization reaction is preferably conducted in separate steps so that resin microparticles form a plurality of layers having different molecular weight. This process for preparing the resin particles by polymerization reaction in a step-by-step manner is called as the multi-step polymerization process. For example, it enables to obtain resin microparticles having a gradient of molecular weight from the center to the surface of the particle. Further, after preparing resin microparticles dispersion having a higher molecular weight, by newly adding a polymerizable monomer and a chain transfer agent to the resin microparticles dispersion, a lower molecular weight may be formed as a surface layer.

In the case of preparing resin microparticles, from the viewpoint of the stability and the anti-crush strength of the obtained toner, it is preferred to apply the multi-step polymerization including three or more polymerization steps. The two- and tree-step polymerization methods, which are representative examples of the multi-step polymerization process, are described below.

(Two-step Polymerization Method)

The two-step polymerization method is a method for producing the resin microparticle having two domains, for example, such as the central portion comprising the high molecular weight resin and an outer layer comprising the low molecular weight resin. In the two-step polymerization method, the resin microparticles are prepared by two polymerization reaction steps as the first polymerization step and the second polymerization step.

For example, in case of preparing resin microparticles having different molecular weight distribution, a polymerizable monomer for the high molecular weight resin is prepared, and is dispersed in an aqueous medium in a form of oil drop by supplying mechanical energy, and the system is subjected to a polymerization treatment (the first polymerization step) to prepare a dispersion of a higher molecular weight resin particles.

Next, a polymerization initiator and a polymerizable monomer for forming the lower molecular weight resin are added to the prepared dispersion of the resin microarticles, and the polymerizable monomer is subjected to a polymerization treatment (the second polymerization step). Thus, formed is the resin micro particle having two layered structure having a covering resin layer composed of the lower molecular weight resin onto the resin microparticle having high molecular weight (Three-step Polymerization Method)

The three-step polymerization method is a method for producing the resin microparticle having three domains, for example, comprised of the central portion comprising the high molecular weight resin, the inter layer containing the toner constituting material such as wax and an outer layer comprising the low molecular weight resin. In the three-step polymerization method, the resin microparticles are prepared by three polymerization reaction steps as the first polymerization step, the second polymerization step and the third polymerization step.

For example, in case of preparing resin microparticles having different molecular weight distribution and containing the toner constituting material such as wax, at first, a polymerizable monomer for the high molecular weight resin is prepared, and the system is subjected to a polymerization treatment as the same manner as the two-step polymerization method described above (the first polymerization step) to prepare a dispersion of a higher molecular weight resin particles.

Next, as well as the prepared resin microparticles are added to the aqueous dispersion, a polymerizable monomer solution which solves the toner constituting material such as wax are added and dispersed in an aqueous medium in a form of oil drop, and the system is subjected to the second polymerization treatment (the second polymerization step) to prepare a resin dispersion having composite structure (hereinafter referred to as composite resin microparticle) having an inter layer containing the toner constituting material such as wax onto the resin microparticle having high molecular weight.

Next, a polymerization initiator and a polymerizable monomer for forming the lower molecular weight resin are added to the dispersiom of the resin microarticles formed through the second polymerization step, and the polymerizable monomer is subjected to a polymerization treatment (the third polymerization step) under the presence of the composite resin microparticles. Thus, formed is the resin micro particle having three layered structure having a covering resin layer composed of the lower molecular weight resin onto the surface of he composite resin microparticles.

(2) Process of Coagulation and Fusion of the Resin Microparticles (Process of Association)

This is a process to form particles by coagulating resin microparticles formed by the above described process in the aqueous medium and to form particles (mother particles for toner before process of external additive addition) by fusing the coagulated particles by heating, and is called a process for associating resin microparticles. Namely, it is a process to form the mother particles for toner particles by coagulating and fusing the resin microparticles formed by polymerizing the vinyl polymerable monomer by the above described emulsion polymerization method.

In this step, a coagulant of an alkali metal salt or an alkaline earth metal salt such as magnesium chloride is added to an aqueous medium containing resin particles to coagulate these particles. Subsequently, the aqueous medium is heated at a temperature higher than the glass transition temperature of the resin particles to allow coagulation to proceed and to allow coagulated resin particles to fuse. When allowing coagulation to proceed and reach the targeted particle size, a salt such as sodium chloride is added to stop coagulation.

(3) Process of Ripening.

Ripening process is a process which is performed by heating treatment followed by the process of coagulation and fusion described above until the shape of resin particles reaches the intended average circularity, and is called a process of shape controlling.

(4) Process of Cooling:

This step refers to a stage that subjects a dispersion of the foregoing resin particles to a cooling treatment (rapid cooling). Cooling is performed at a cooling rate of 1 to 20° C./min. The cooling treatment is not specifically limited and examples thereof include a method in which a refrigerant is introduced from the exterior of the reaction vessel to perform cooling and a method in which chilled water is directly supplied to the reaction system to perform cooling.

(5) Process of Washing:

In the washing step, a solid-liquid separation treatment of separating resin particles from the resin particle dispersion is conducted, then applied is a washing treatment for removing adhered material such as a surfactant or salting-out agent from a surface of resin particles in a cake form called as a wet toner cake through solid-liquid separation.

In this step, washing is conducted until the filtrate reaches a conductivity of 10 μS/cm. A filtration treatment is conducted, for example, by a centrifugal separation, filtration under reduced pressure using a Buchner's funnel or filtration using a filter press, but the treatment is not specifically limited.

(6) Process of Drying:

In this step, the washed resin particles are subjected to a drying treatment to obtain dried particles. Drying machines usable in this step include, for example, a spray dryer, a vacuum freeze-drying machine, or a vacuum dryer. A standing plate type dryer, a movable plate type dryer, a fluidized-bed dryer, a rotary dryer or a stirring dryer is preferably used.

The moisture content of the dried toner particles is preferably not more than 5% by mass, and more preferably not more than 2%. When toner particles that were subjected to a drying treatment are aggregated via a weak attractive force between particles, the aggregate may be subjected to a pulverization treatment. Pulverization can be conducted using a mechanical pulverizing device such as a jet mill, Henschel mixer, coffee mill or food processor.

The mother particles for toner can be manufactured by the process to drying above.

(7) Process of External Additive Addition:

In this external additive treatment step, external additives or a lubricant is added to dried mother particles for toner. The mother particles for tone which were subjected to the drying step may be used as toner particles for forming a foil transferring face, but addition of external additives can enhance the electrostatic-charging property, fluidity and cleaning property. External additives usable in the present invention include, for example, conventional inorganic or organic particles and aliphatic metal salts. An external additive is added preferably in an amount of 0.1 to 10.0% by mass, and more preferably 0.5 to 4.0% by mass. A variety of additives may be combined. Examples of a mixing device, used to add external additives include conventional mechanical mixing device such as a tabular mixer, a HENSCHEL MIXER, a NAUTA Mixer, a V-type mixer and a coffee mill.

Specific examples of conventional inorganic microparticles include: minute silica, titanium, alumina particles and strontium titanate. These minute inorganic particles subjected to hydrophobic processing may be used Specifically listed as silica microparticles, for example, are commercially available R-805, R-976, R-974, R-972, R-812, and R-809, produced by Nippon Aerosil Co. Ltd.; HVK-2150 and H-200, produced by Hoechst AG; commercially available TS-720, TS-530, TS-610, H-5, and MS-5, produced by Cabot Corp.

Listed as titanium microparticles, for example, are commercially available T-805 and T-604, produced by Nippon Aerosil Co.; commercially available MT-100S, MT-100B, MT-500BS, MT-600, MT-600SS and KA-1, produced by TAYCA CORPORATION; commercially available TA-300SI, TA-500, TAF-130, TAF-510 and TAF-510T, produced by Fuji Titanium Industry Co., Ltd.; commercially available IT-S, IT-OA, IT-OB and IT-OC, produced by Idemitsu Kosan Co.

Listed as alumina microparticles, for example, are commercially available RFY—C and C-604, produced by Nippon Aerosil Co., commercially available TTO-55, produced by ISHIHARA SANGYO KAISHA, LTD.

Further, employed as fine organic particles are fine spherical organic particles having a number average primary particle diameter of 10 to 2,000 nm. Employed as such particles may be homopolymers or copolymers of styrene or methyl methacrylate.

The added amount of these external agents is preferably 0.1 to 10% by mess with respect to the toner.

The foil transferring face forming toner can be manufactured by the emulsion association method mentioned above.

Surfactants, polymerization initiator, dispersion stabilizer and so on used in the manufacturing the foil transferring face forming toner, are described The resin composing the foil transferring face forming toner includes a vinyl based monomer having a plurality of polar groups and other vinyl based monomer. Conventional oil soluble or water soluble polymerization initiator can be used. There are usable oil-soluble polymerization initiators include the following azo, diazo or peroxide initiators;

(1) Azo-Type or Diazo-Type Polymerization Initiators:

2,2'-azobis-(2,4-dimethylvaleronitrile), 2,2'-azobisisobutyronitrile, 1,1'-azobiscyclohexanone-1-carbonitrile), 2,2'-azobis-4-methoxy-2,4-dimethylvaleronitrile, and azobisisobutyronitrile.

(2) Peroxide Based Polymerization Initiators:

benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxy-cyclohexane)propane, and tris-(t-butylperoxy) triazine.

Water-soluble radical polymerization initiator can be used for forming resin particles by emulsion polymerization method. Examples of a water-soluble polymerization initiator include persulfates such as potassium per sulfate and ammonium persulfate, azobisaminodipropane acetate, azobiscyanovaleric acid and its salts, and hydrogen peroxide.

Conventional chain-transfer agents are usable for the purpose of controlling the molecular weight of resin particles. Examples of the chain-transfer agents include n-octylmercaptan, dodecylmercaptane, tert-dodecylmercaptan, n-octyl-3-mercaptopropionic acid ester, terpinolene, carbon tetrabromide, and α-methylstyrene dimmer.

Further, according to the present invention, the foil transferring face forming toner is formed by polymerizing a vinyl based monomer having a plurality of polar groups and other vinyl based monomer in a state of dispersing in the aqueous medium, by dispersing the obtained resin particle in the aqueous medium, and by coagulating and fusing thereof It is preferred to use a dispersion stabilizer to stabilize the toner material in an aqueous medium. Practical example of the dispersion stabilizer includes tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica and alumina. The following surfactants can be used as the dispersion stabilizer; polyvinyl alcohol, gelatin, methylcellulose, sodium dodecylbenzene sulfonate, ethylene oxide adducts and sodium higher alcohol sulfate, which are generally used as a surfactant.

Further, in case of polymerizing a polymerizable monomer in an aqueous medium, it is necessary to disperse droplets of the polymerizable monomer uniformly in the aqueous medium by using surfactant Available surfactant is not limited, but an ionic surfactant described below is preferably used. Ionic surfactant includes sulfonates, sulfate esters and fatty acid salts. Specific examples of sulfonate include sodium dodecylbenzenesulfonate, sodium arylalkyl polyether sufonate, sodium 3,3-disulfondisphenylurea-4,4-diazo-bis-amino-8-naphthol-6-sulfonate, ortho-carboxybenzene-azo-dimethylaniline, 2,2,5,5-tetramethyl-triphenylmethane-4,4-diazo-bis-β-naphthol-6-sulfonate.

Specific examples of sulfate esters include: sodium dodecylsulfate, sodium tetradecylsulfate, sodium pentadecylsulfate, and sodium octylsulfate; fatty acid salts include sodium oleate, sodium laurate, sodium caprate, sodium caprylate, sodium caproate, potassium stearate, and calcium oleate.

Nonionic surfactants are also usable. Examples thereof include polyethylene oxide, polypropylene oxide, a combination of polypropylene oxide and polyethylene oxide, an ester of polyethylene glycol and a higher fatty acid, alkylphenol polyethylene oxide, an ester of polypropylene oxide and a higher fatty acid, and sorbitan ester.

The method for forming the image by employing the foil transferring face forming toner of the present invention (hereinafter referred to as method for transferring foil) will now be detailed. The method for transferring foil of the present invention can be attained by undergoing the following processes from (1) to (7):

(1) forming an electrostatic latent image by exposing an electrophotographic photoreceptor, (2) forming a foil transferring face by supplying a foil transferring face forming toner related to the present invention onto the electrophotographic photoreceptor having the electrostatic latent image, (3) transferring the foil transferring face formed on the electrophotographic photoreceptor to a base substance, (4) fixing the foil transferring face by heating which is transferred on the base substance, (5) supplying a transfer foil to the base substance having the fixed foil transferring face, (6) heating the transfer foil, and (7) peeling the transfer foil from the base substance while leaving a portion of the transfer foil adhered on the foil transferring face.

Thus, in the method of foil transfer of the present invention, at first, a photoreceptor is exposed to form an electrostatic latent image having the shape of the foil transferring face to be formed on the product and the foil transferring face forming toner of the present invention is supplied to the photoreceptor on which the electrostatic latent image is formed, whereby a foil transferring face is formed. The foil transferring face formed on the photoreceptor is transferred onto a base substance, and a transfer foil is supplied onto the base substance having the foil transferring face which is fixed by heating to be in contact with the base substance. Under this state, the transfer foil and foil transferring face are heated to transfer the foil onto the foil transferring face.

The method for transferring foil will now specifically be described that with reference to the accompanying drawings. FIG. 1 is a schematic diagram which shows a procedure reflecting steps of (4) to (7) among above steps (1) to (7). Through steps (1) to (3) (not illustrated in FIG. 1), a foil transferring face H is formed on a base substance P, a transfer foil F is supplied onto the base substance P, the supplied transfer foil F is contacted to the foil transferring face H and heated, and a foil f2 is transferred on the foil transferring face H. FIG. 1*a* to FIG. 1*d* will now specifically be described.

FIG. 1*a* is a cross-sectional view of a base substance P formed thereon the foil transferring face by using the toner related to the present invention on a sheet base substance. A method for forming the foil transferring face H on the base substance P through steps (1) to (3) will be described later with reference to FIG. 3.

Figure 1B:
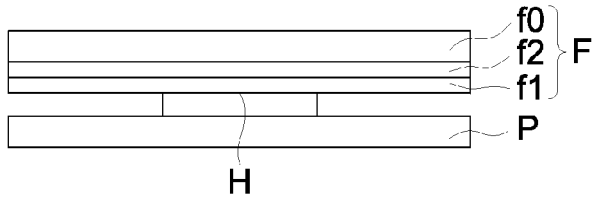

FIG. 1*b* illustrates a state in which a transfer foil F is supplied onto a base substance P. Transfer foil F is supplied to form contact with foil transferring face H. Supplied transfer foil is considered to be contacted with all over the base substance P, therefore, at least to form contact with the foil transferring face H convexly formed on the base substance. The transfer foil F of the present invention has at least a foil layer f2 on a base film f0, and may have an adhesive layer f1 for enhancing an adhesive property with the foil transferring face H. The transfer foil F applicable to the present invention will be detailed later.

Figure 1C:
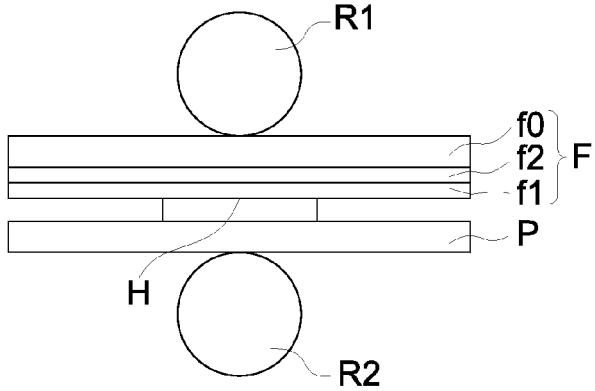

FIG. 1*c* illustrates a state in which a base substance P is passed between heat and pressure rolls R1 and R2 which are heating media while the transfer foil F is in contact with the base substance P. During the time that the base substance P is passed between heat and pressure rolls R1 and R2, the adhesive layer f1 of the transfer foil F contacted with the foil transferring face H is melted. Then, after passing through between heat and pressure rolls R1 and R2, the adhesive layer f1 of the transfer foil F contacted with the foil transferring face H is cooled to be hardened, whereby the transfer foil F forms strong adhesive state with the foil transferring face. Thus, the transfer foil F forms adhesive state between an area of being contacted with the foil transferring face H on the base substance P and the foil transferring face H, whereby transferred is a foil which has a shape coincident to the shape of the foil transferring face H.

Figure 1D:
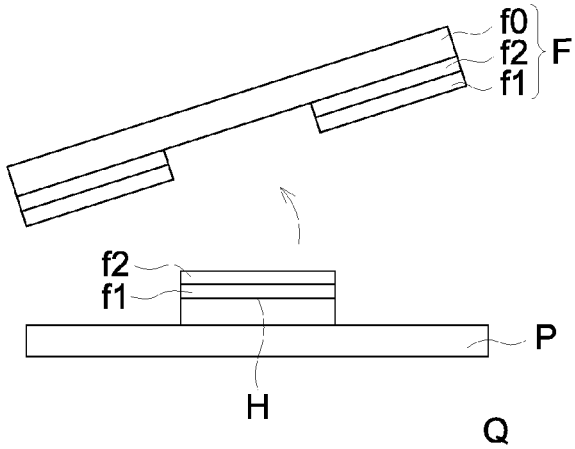

FIG. 1*d* illustrates a state in which the transfer foil F is peeled off from the base substance P which adheres to the transfer foil F through the foil transferring face H. After peeling off the transfer foil F, a foil layer f2 is transferred on the foil transferring face H of the base substance P through the adhesive layer f1. According to the present invention, the foil layer f2 is transferred correspondingly to the shape of the foil transferring face by using a toner for forming the foil transferring face, whereby the foil layer f2 having the predetermined shape enables to be transferred without using a metal press.

Thus, the foil transferred onto the base substance P is carried out by melting the adhesive layer f1 of the transfer foil F during the base substance P being passed between heat and pressure rolls R1 and R2, forming adhesive state between the transfer foil F and the base substance P by cooling to be hardened, and by peeling off the transfer foil F.

Figure 1E:
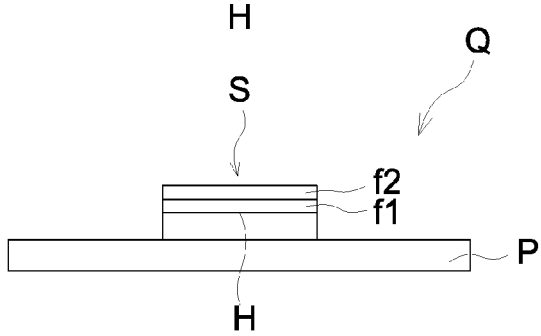

Through above procedure, as shown in FIG. 1*e*, the foil layer f2 is transferred onto the base substance (image support) P through the foil transferring face H formed by foil transferring face forming toner, whereby foil image S is formed. According to the present invention, even when heat treatment is carried out so as to form further toner image on the base substance P having foil image S, the foil transferring face H does not causes any deformation, whereby the foil image does not cause bad quality such as stripe or falling off of the foil. Accordingly, by applying the foil image having excellent resistance on the base substance P, contribution to the improvement of the aesthetic appearance due to the foil transfer of the product Q having the foil image S on the base substance P can also be acquired.

Next, an example of the foil transferring face formation devices which enables to form a foil transferring face on a base substance employing the foil transfer method of the present invention will be explained using FIG. 2. The foil transferring face formation device 1 in FIG. 2 enables to perform the steps (1) to (3) among steps (1) to (7), and it has a photoreceptor which forms an electrostatic latent image by light exposure. A foil transferring face corresponding to the electrostatic latent image is formed by supplying the foil transferring face forming toner of the present invention to the photoreceptor, followed by transferring the formed foil transferring face onto a base substance.

Figure 2:
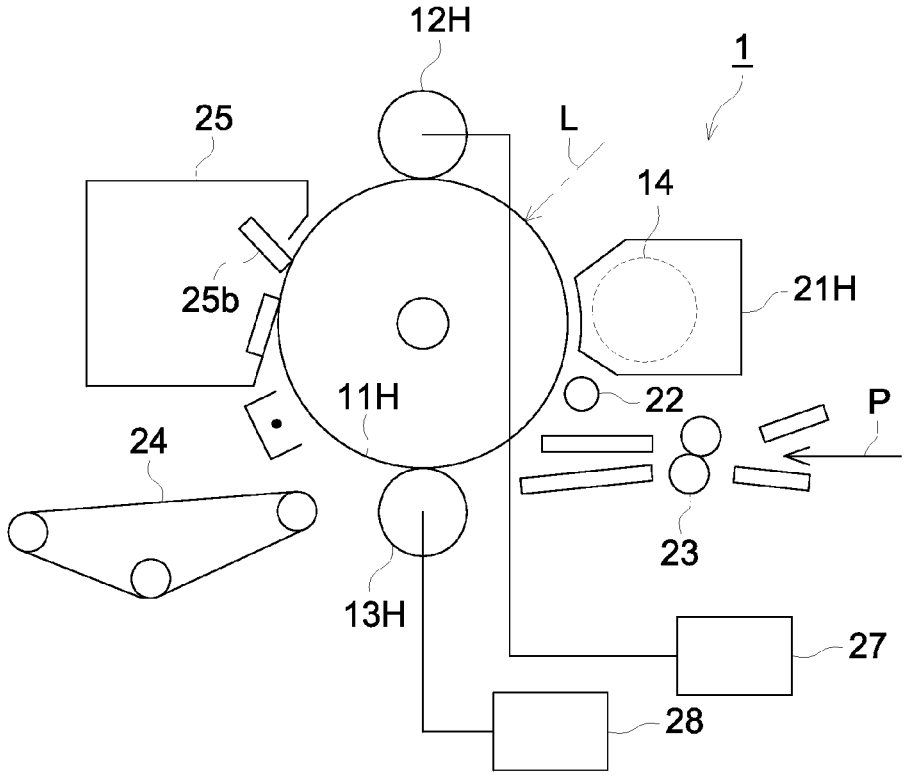
FIG. 2 is a schematic diagram of a foil transferring face formation devices which forms a foil transferring face by an electrostatic latent image method.

In the foil transferring face formation device 1 of FIG. 2, an electrostatic latent image is formed on the photoreceptor 11H charged with the charging roller 12H in the figure, when the photoreceptor is irradiated with the exposing light L. From the toner feeder 21H of a foil transferring face forming toner provided in the vicinity of the photoreceptor 11H, a foil transferring face forming toner is supplied to the electrostatic latent image formed on the photoreceptor 11H to form a foil transferring face. At this lime, the toner feed roller 14 built in the toner feeder 21H of a foil transferring face forming toner is rotated to supply the toner attached on the toner feed roller 14 to the photoreceptor 11H, whereby a foil transferring face is formed on the photoreceptor 11H.

Figure 3:
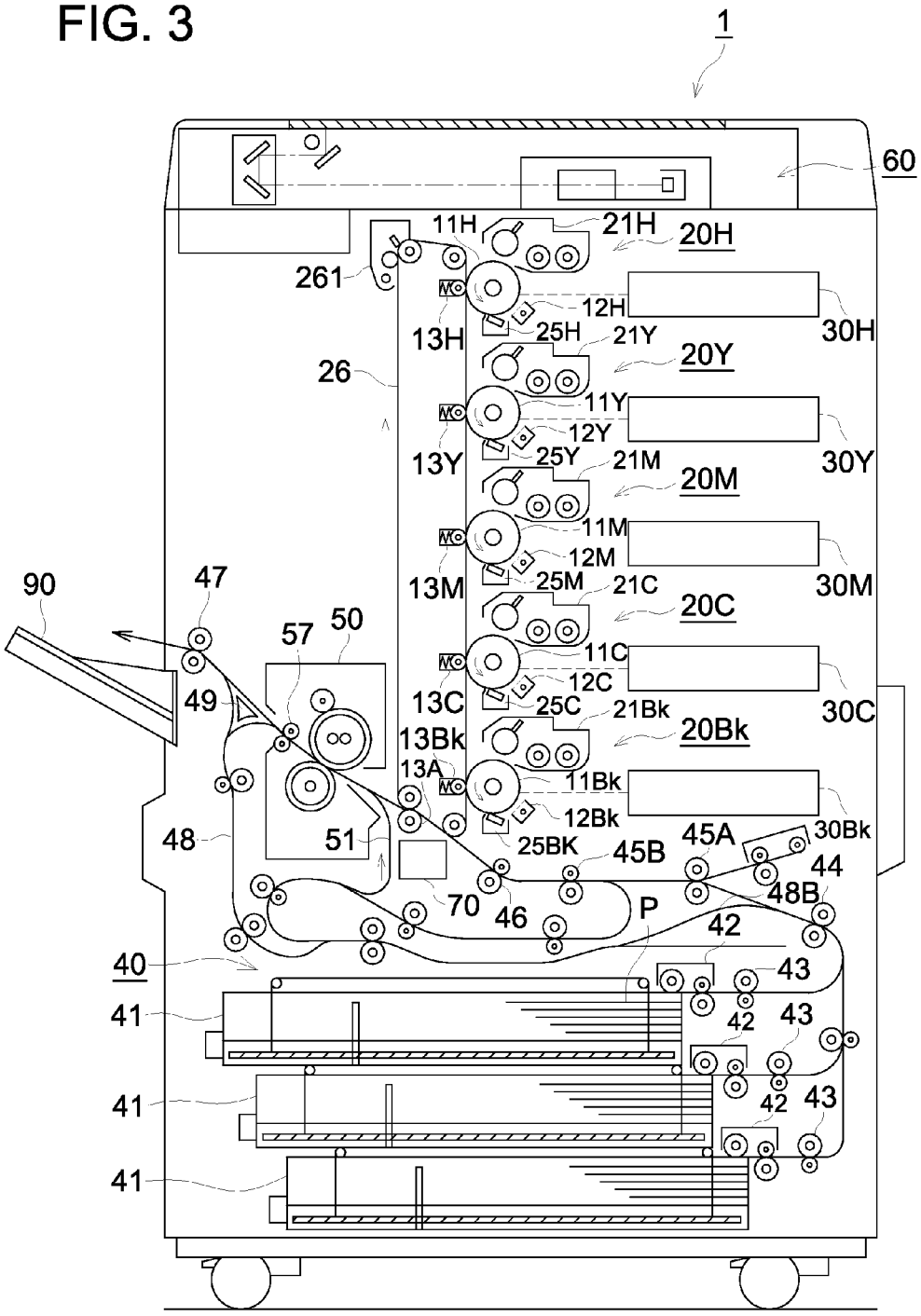
FIG. 3 is a cross-sectional construction view of a foil transferring face formation devices which can form a full color toner image on a base substance with a transferred foil.

Next, when the electric charge on Photoreceptor 11H is neutralized with the neutralizing lamp 22, the foil transferring face on the Photoreceptor 11H is transferred onto the substrate p1 which constitutes the base substance P in the transfer section where the Photoreceptor 11H and the transfer roller 13H are placed close to each other. The base substance P which is a sheet like material, typically a transfer paper, shown in FIG. 3 is conveyed from the paper cassette which is not illustrated to the transfer section by the conveying roller 23, where an electric charge of the reverse polarity with the polarity of the foil transferring face forming toner is given to the base substance P by the transfer roller 13H. The foil transferring face is transferred onto the substrate p1 from the photoreceptor 11H according to an electrostatic action of the electric charge of the reverse polarity given by the transfer roller 13H.

The base substance P on which the foil transferring face is transferred is conveyed to the fixing device which is not illustrated by the conveyance belt 24, after separated from the photoreceptor 11H. The fixing device has a fixing means, for example, a heating roller and a pressure roller, and melts the foil transferring face formed on the base substance P to fix the foil transferring face.

According to the aforementioned procedure, in the foil transferring face formation devise 1 shown in FIG. 2, an electrostatic latent image corresponding to the shape of the foil is formed on the photoreceptor 11H, a foil transferring face forming toner is supplied on the photoreceptor 11H to form a foil transferring face, and the foil transferring face formed on the photoreceptor 11H is transferred onto the substrate p1 which constitutes the base substance P with the transfer roller 13H.

The charging roller 12H shown in the figure charges the photoreceptor 11H according to the following procedure. Namely, the charging roller 12H is applied with a bias voltage which is composed of a direct-current (DC) component and an alternating current (AC) component from the power supply 27 to charge the photoreceptor drum 11H. The charging method used for the charging roller 12H shown in FIG. 2 is called a contact charging method, and, in the present invention, a non-contact charging method used in the device which will be explained later in FIG. 3 is also applicable to charge the photoreceptor besides the charging system shown in FIG. 2. The bias voltage impressed to the charging roller 12H is a superimposed voltage of, for example, a DC bias of ±500-1000V which is a direct current component, and an AC bias of 100 Hz-10 kHz and 200-3500V which is an alternating current component.

The transfer roller 13H in FIG. 2 is also impressed with a bias voltage containing both a direct current (DC) component and an alternating current (AC) component, as well as the charging roller 12H, to transfer the foil transferring face formed on the photoreceptor 11H onto the base substance P. A specific example of a bias voltage impressed to the transfer roller 13H includes a superimposed voltage of a DC bias of ±500-1000V which is a direct current component, and an AC bias of 100 Hz-10 kHz and 200-3500V which is an alternating current component, similarly to the specific example of a bias voltage impressed to the charging roller 12H.

The charging roller 12H and the transfer roller 13H may be driven by the photoreceptor 11H while being pressed onto the photoreceptor or may be driven by themselves. The pressing force of these rollers to the photoreceptor drum 11H is, for example, $9.8\times10^{-2}$-$9.8\times10^{-1}$ N/cm and a rotation speed of the rollers are, for example, as 1 to 8 times as peripheral speed of the photoreceptor 11. The above pressing force of the rollers onto the photoreceptor 11H can be obtained, for example, by applying a force of 1 N-10 N to both ends of the charging roller 12H.

In addition, the residual toner on the photoreceptor 11H after transferring the foil transferring face to the base substance P is removed by the cleaning blade 25*b* provided in the cleaning device 25 to be ready for performing the next foil transferring face formation. Further, by repeating above described steps (1) to (7) by repeatedly employing the foil transferring face formation device shown in FIG. 2, "re-transferring of foil" can be acquired, which forms an overprinted foil image on the formed foil image by transferring another foil.

Further, in the present invention, after transferring a foil onto the foil transferring face on the base substance, it is also possible to form a visible image on the base substance by using toners. For example, a foil transferring face is formed on a base substance and a foil is transferred on the foil transferring face, followed by forming a toner image around the transferred foil via an electrophotographic method. Or, it is also possible to form an image having a different type of hue by providing a color toner on the foil. According to these methods, a further luminosity expression can be given to a product having a transferred foil.

FIG. 3 is a cross-sectional configuration diagram of a foil transferring face forming device which is capable of forming a foil transferring face, transferring a foil onto the formed foil transferring face, and forming a full color toner image. Formation of the foil transferring face onto the base substance via foil transferring face formation device shown in FIG. 3 is carried out as the similar procedure as a foil transferring face formation device 1 shown in FIG. 2. The foil transferring face formation device 1 shown in FIG. 3 has a fixing devise 50 by which the foil transferring face H formed by employing foil transferring face forming toner is heated and pressed to be hardened.

The foil transferring face forming device 1 shown in FIG. 3 has a structure similar to that of an electrophotographic image forming apparatus so called as a "tandem type color image forming apparatus" and contains a foil transferring face forming unit 20H, a plurality of toner image forming units 20Y, 20M, 20C and 20Bk, a belt-like intermediate transfer belt 26, a sheet feeder 40 and a fixing device 50. Specifically, in the foil transferring face forming device 1 shown in FIG. 4, a transfer foil feed unit 70 is provided below the intermediate transfer belt 26.

In the foil transferring face formation device 1 of FIG. 3, at first a layer of a foil transferring face forming toner is formed on a photoreceptor 11H in a foil transferring face forming section 20H, then the toner layer is transferred onto a base substance P, followed by fixing the toner layer by fixing device 50 to form a foil transferring face H. Then, a transfer foil is supplied onto a base substance having the foil transferring face H, and the foil is transferred onto the foil transferring face H by passing through fixing device 50 again. Further, a full color image can be formed using a color toner on the base substance P on which a foil has been transferred and the base substance P having full color image is fixed by fixing device 50. In these processes, the foil transferring face formation device 1 of FIG. 3 enable to form a product Q which has a foil image and toner image on the base substance P. Namely, the foil transferring face formation device 1 of FIG. 3 enable to form the image through "a step of heating a base substance on which foil transferring face foil is transferred" in the present invention.

In the foil transferring face forming device 1 shown in FIG. 3, the transfer foil feed unit 70 is provided below the intermediate transfer belt 26, however, the position of the transfer foil feed unit is not specifically limited as far as foil transfer is capable by heating and pressing in the fixing devise 50, after supplying a transfer foil.

Figure 4:
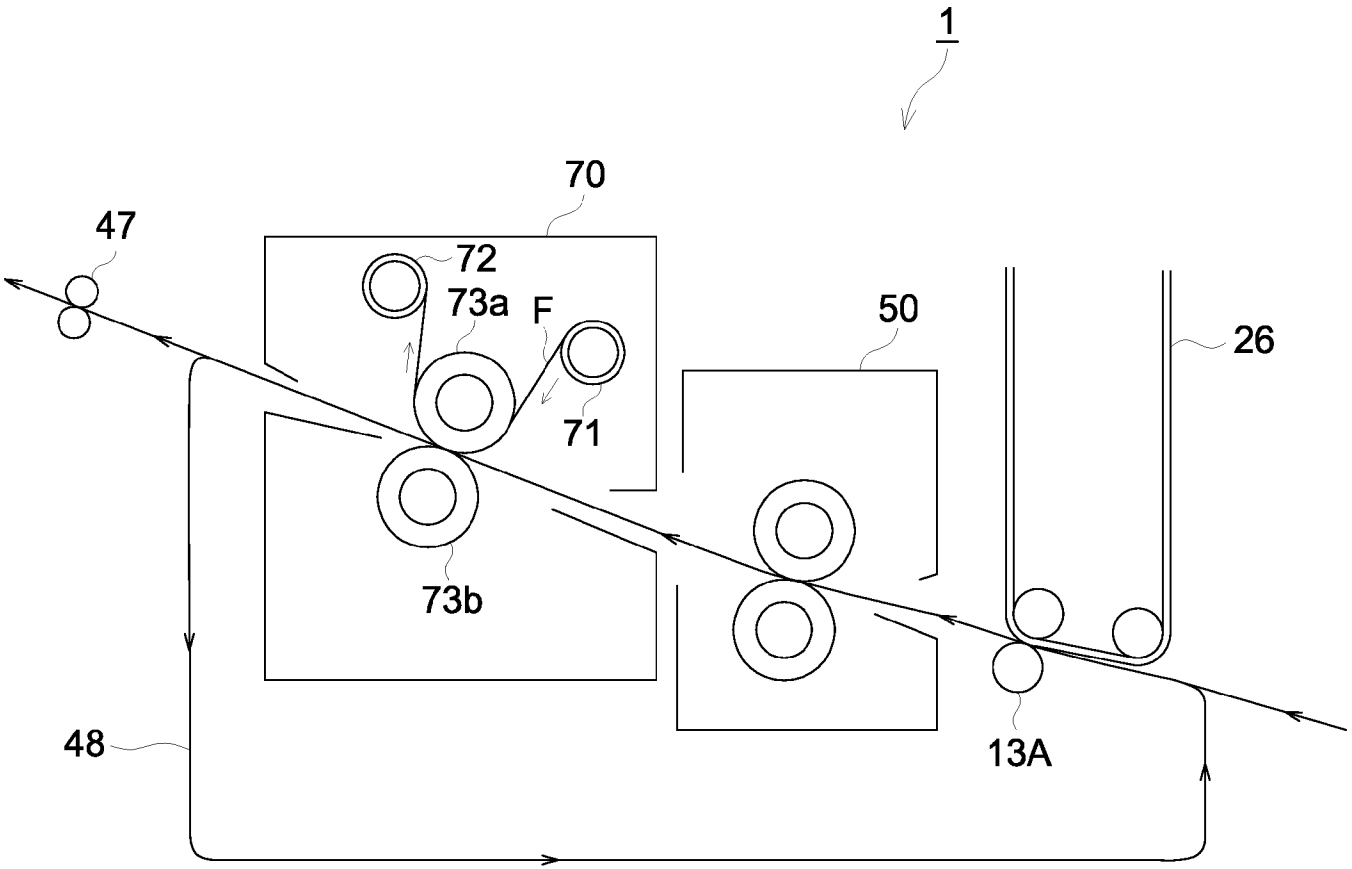
FIG. 4 is a schematic diagram which shows an arrangement of an intermediate transfer belt, a fixation unit and a supply unit of a transfer foil.

With respect to the configuration of the intermediate transfer belt 26, the fixing device 50, and the transfer foil feed unit 70, for example, a configuration shown in FIG. 4 may also be cited as a preferable example, in addition to the configuration shown in FIG. 3. In the foil transferring face formation apparatus 1 shown in FIG. 4, the intermediate transfer belt 26, the fixing device 50, and the transfer foil feed unit 70 are sequentially arranged. The arrow head in this figure represents the conveying direction of the base substance P. The transfer foil feed unit 70 shown in FIG. 4 has a transfer foil supply roll 71, foil transfer rollers 73*a* and 73*b* and a transfer foil winding roller 72, in which a transfer foil F is provided from the transfer foil supply roll 71, and the spent transfer foil F after foil transfer is rolled up by the transfer foil winding roller 72. In FIG. 4, the foil transferring face formation unit 20H, the toner image formation units 20Y, 20M, 20C and 20Bk are omitted. FIG. 4 will be described in detail later.

Further, the foil transferring face forming device 1 shown in FIG. 3 will be detailed. An image reading device 60 is installed in the upper part of the foil transferring face forming device 1. A manuscript placed on a manuscript holder is image-scanning-exposed to light emitted by an optical system of a manuscript image-scanning exposure device in the image reading device 60 to read the image in a line image sensor. The analog signals photoelectrically converted by the line image sensor are input to light exposure devices 30H, 30Y, 30M, 30C and 30Bk, after conducting analog processing, A/D conversion, a shading correction and image compression processing in control section.

In FIG. 3, in naming a component generically, the reference numerals in which alphabet subscript is omitted are used, and in pointing out discrete components, the reference numerals which is attached with the subscript of H (for foil transferring face), Y (yellow), M (magenta), C (cyan), and Bk (black) are used.

The foil transferring face forming toner supplier unit 20H which supplies the foil transferring face forming toner of the present invention, the yellow image forming unit 20Y which performs toner image formation of yellow color, the magenta image forming unit 20M which performs toner image formation of magenta color, the cyan image forming unit 20C which performs toner image formation of cyan color, black image forming unit 20Bk which performs toner image formation of black color each respectively have the following constitution. Namely, (1) drum-like photoreceptor 11 (11H, 11Y, 11M, 11C, 11Bk)
(2) charging electrode 12 (12H, 12Y, 12M, 12C, 12Bk)
(3) light exposure unit 30 (30H, 30Y, 30M, 30C, 30Bk)
(4) foil transferring face forming toner supplier unit 21H, and toner supplier unit 21 (21Y, 21M, 21C, 21Bk)
(5) cleaning unit 25 (25H, 25Y, 25M, 25C, 25Bk).

The photoreceptor 11 contains an organic photoreceptor in which a photoreceptor layer containing a resin in which an organic photoconductor is incorporated is formed on a peripheral surface of a drum shaped metal support, which is placed extending toward the width direction of the base substance p1 constituting the base substance P (a direction perpendicular to the paper sheet in FIG. 3). As a resin for the photoreceptor layer formation, a well-known resin for forming a photoreceptor layer such as polycarbonate is used. In the embodiment shown in FIG. 3, an example in which a drum shaped photoreceptor 11 is used, however, the photoreceptor is not limited thereto and a belt shaped photoreceptor may be used.

The foil transferring face forming toner supplier unit 21H includes a two-component developer containing the foil transferring face forming toner (T) of the present invention and carrier. Further, the developing units 21 each include respective two-component developer containing a carrier and, respectively, a yellow toner (Y), a magenta toner (M), a cyan toner (C) and a black toner (Bk). The two-component foil transferring face forming developer is constituted of a carrier having ferrite particles on which an insulating resin is coated and the foil transferring face forming toner of the present invention. The two-component developers each are constituted of, for example, a carrier having ferrite particles on which an insulating resin is coated, a well-known binder resin, a colorant such as a well-known pigment or carbon black, a charge control agent, silica, or titanium oxide.

As for a carrier, the average particle diameter is 10-50 μm and the saturation magnetization is 10-80 emu/g. The average particle diameter of the toner is 4-10 μm. The electrification characteristic of the toner used in the image forming device shown in FIG. 4 is preferably a negative electrification characteristic and the amount of average electric charge is preferably −20 to −60 μC/g. The mixing ratio of the toner and the carrier in each of the two-component developers and in the two-component foil transferring face forming developer is adjusted so that the content of the toner is 4-10% by mass.

The intermediate transfer belt 26 which is an intermediate transfer medium is rotatably supported by plural rollers. The intermediate transfer belt 26 is an endless belt exhibiting a volume resistance of preferably $10^6$-$10^{12}$ Ω·cm. The intermediate transfer belt 26 may be formed with a well-known resin, for example, polycarbonate (PC), polyimide (PI), polyamideimide (PAD, polyvinylideine fluoride (PVDF), or a tetrafluoroethylene-ethylene copolymer (ETFE). The thickness of the intermediate transfer belt 26 is preferably 50-200 μm.

The foil transferring face H formed on the photoreceptor 11H with the toner supplied from foil transferring face forming toner supplier unit 21H is transferred onto the rotating intermediate transfer belt 26 with the primary transfer roller 13H (primary transfer). The foil transferring face H transferred onto the intermediate transfer belt 26 is then transferred onto a base substance P which is supplied by the sheet feeder 40 which will be described later. The base substance P on which the foil transferring face H is transferred is passed through a fixing device 50 which will be described later to fix the foil transferring face H.

The base substance P of which the foil transferring face H has been fixed is once conveyed through a discharge path having an eject roller 47, and then, through a conveyance path 48, conveyed to the transfer foil supplying path 51 where a transfer foil is supplied from the transfer foil supplier 70. Further, the base substance P supplied with the transfer foil is passed through the fixing device 50 again, while the transfer foil being supplied, to transfer a foil onto the foil transferring face H by heating and pressing in the fixing device 50.

The base substance P on which formation of the foil transferring face H and the transfer of the foil were thus performed is conveyed in front of the intermediate transfer roller 26 via the above-mentioned double-sided conveyance path 48, and, then, a toner image is formed. First, each color image formed on each of the photoreceptors 11Y, 11M, 11C, 11Bk, respectively, using each color toner supplied by each of toner supplier writs 21Y, 21M, 21C and 21Bk, respectively, is sequentially transferred onto intermediate transfer belt 26 employing each of primary transfer rollers 13Y, 13M, 13C, and 13Bk, respectively, whereby a combined full color image is formed. On the other hand, residual toners on the photoreceptor 11H from which the foil transferring face H was transferred and photoreceptors 11Y, 11M, 11C and 11Bk from which toner images were transferred are removed using cleaning units 25 (25H, 25Y, 25M, 25C and 25Bk), respectively.

The base substance P stored in storing member 41 (tray) in sheet feeder 40 is fed to first feeding member 42 and conveyed through feeding rollers 43, 44, 45A, 45B, and resist roller 46 (second feeding member) to secondary transfer roller 13A, where the foil transferring face H and the color image are transferred onto the base substance P (secondary transfer).

The three vertically arrayed storing members 41 in the lower portion of the foil transferring face forming device 1 were provided with the same number since these three members have almost the same structure. Also, the three vertically arrayed feeding members 42 were provided with the same number since the structures are almost the same. The storing members 41 and the feeding members 42 in all are named as a sheet feeder 40.

The foil transferring face H and the full color image transferred onto the base substance P are fixed on the base substance P by fixing unit 50 which hardens the foil transferring face H and the full color image by heating and pressing. The base substance P is conveyed between a pair of conveying rollers 57, discharged through discharge rollers 47, and placed on a discharge tray 90 which is outside of the image forming device.

After transferring the foil transferring face H and the full color toner image onto the base substance P using the secondary transfer miler 13A, followed by separating the base substance P by curvature separation, the residual toner on the intermediate transfer belt 26 is removed by a cleaning member 261 for the intermediate transfer belt When the foil transferring face H and the full color toner image are formed on both surfaces of the base substance P, a foil transferring face and a full color image are formed on the 1st page of the base substance P, followed by melting them to harden, and the base substance P is bifurcated from the discharge path with the bifurcation plate 49. The base substance P is then introduced to a conveyance path 48 to convert the front side and the rear side, followed by conveying again to the feeding roller 45B. Also on the second surface, a foil transferring face H and a full color image are formed using the foil transferring face forming unit 20H and the image forming unit of each color 20Y, 20M, 20C and 20Bk, followed by being subjected to a heating/pressing treatment using the fixing unit 50, and discharging out of the image forming device using the discharging rollers 47. Thus, a full color toner image provided with a foil transferring face is formed on both surfaces of the base substance P.

In a foil transferring face forming device 1 in which an intermediate transfer belt 26, a fixing devise 50 and a transfer foil feed unit 70 are arranged as shown in FIG. 4, formation of a foil transferring face H, transfer of a foil and formation of a toner image are conducted, for example, according to the following procedure. Namely, (1) transferring the foil transferring face H formed on the intermediate transfer roller 26 onto a base substance P at the secondary transfer roller 13A, (2) fixing the foil transferring face H by passing the base substance P through the fixing device 50, (3) supplying a transfer foil F on the base substance P by the transfer foil feed unit 70, followed by conducting foil transfer, (4) conveying the base substance P transferred with a foil through the conveyance path 48 to the intermediate transfer belt 26, and transferring a full-color toner image onto the base substance P, (5) fixing the full-color toner image by passing the base substance P through the fixing unit 50, and (6) passing the base substance P through the transfer foil feed unit 70, and discharging out of the apparatus through the eject roller 47.

According to the procedure described above, the foil transferring face forming device 1 shown in FIG. 3 or 4 enables: forming a foil transferring face H on a base substance P, transferring a foil onto the foil transferring face H thus formed; and forming a full-color image using color toners on the base substance P having thereon the transferred foil.

Figure 5:
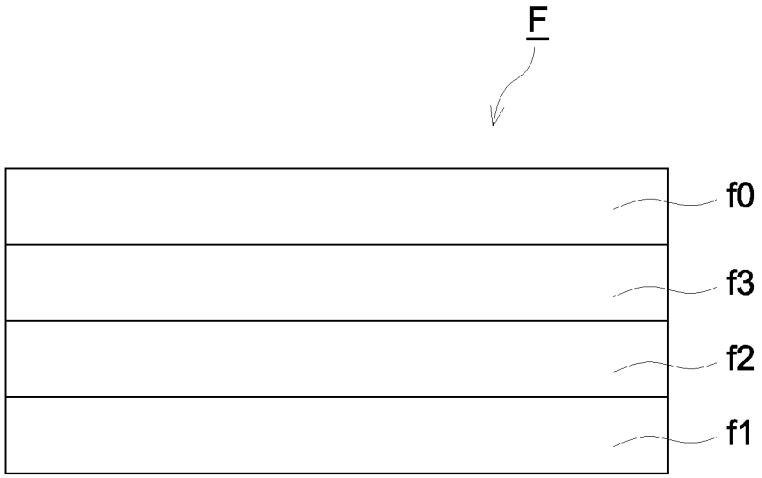
FIG. 5 is a schematic diagram which shows a cross-sectional construction view of a transfer foil.

Next, the transfer foil which can be used in the present invention will be described using FIG. 5. FIG. 5 is a schematic diagram showing a sectional structure of one of the typical transfer foils usable in the present invention. The transfer foil F which can be used in the present invention has at least a film-like support f0 composed of, for example, a resin, a foil layer f2 containing, for example, a colorant or a metal, and an adhesive layer f1 containing an organic material which exhibits an adhesive property, and the foil layer f2 and the adhesive layer f1 transfer onto the base substance P. The adhesive layer f1 is formed on the outermost surface of the transfer foil F, and brought in direct contact with the surface of the base substance P to adhere the foil layer f2 strongly onto the surface of the base substance P, when transferred. Further, the transfer foil F shown in FIG. 5 has a release layer f3 between the support f0 and the foil layer n. Hereafter, each layer of the support f0, foil layer a and adhesive layer f1 will be described.

First, the support f0 is a film or a sheet which is composed of, for example, a resin. As a material of the support f0, well-known resin materials, for example, a polyethylene terephthalate (PET) resin, a polyethylenenaphthalate (PEN) resin, a polypropylen (PP) resin, a polyether sulfone resin and a polyimide resin may be cited. Further, it is also possible to use materials such as paper other than these resin materials.

The support f0 may either have a single layer structure or a multi-layer structure. When a multi-layer structure is adopted in the support f0, it is preferable that the support f0 has a release layer f3, which can be used for adjusting peel resistance, on the outermost surface of the support f0 facing the foil layer f2. Examples of a material for the release layer f3 include: a thermo-curable resin employing melamine or isocyanate as a hardener; and a UV curable resin or an electron beam curable resin containing an acrylic resin or an epoxy resin, which is added with a release agent known in the art.

The foil layer f2 contains, for example, a colorant or a metallic material, and, after it is transferred onto a base substance P, the foil layer f2 provides an aesthetic appearance. The foil layer f2 is expected to be smoothly released form the support f0 when it is transferred onto the base substance P, while the foil layer f2 is expected, after transferred, to exhibit durability since it forms the outermost surface of the base substance P. The foil layer f2 can be formed by applying a well-known resin which meets the above properties on the support f0 using a coater, for example, a gravure coater, a micro-gravure coater or a roll coater. Examples of such a well-known resin include an acrylic resin, a styrene resin and a melamine resin. It is also possible to add a well-known dye or pigment into the resin to provide a color.

When a foil of a finish exhibiting metallic gloss is formed, it is possible to provide the resin with a reflecting layer formed according to a well-known method using, for example, a metal. Examples of a metallic material which forms a reflecting layer include carriers such as aluminum, tin, silver, chromium, nickel and gold. Alloys, for example, a nickel chromium iron alloy, bronze and aluminum bronze are also usable in addition to the above metal carries. Examples of a method to form a reflecting layer using the above metallic materials include well-known methods such as a vacuum evaporation method, a sputtering method and an ion plating method, by which it is possible to form a reflecting layer having a thickness of 10 nm-100 nm. It is also possible to conduct a patterning process to provide a regular pattern using a well-known processing method, such as washing celite processing, etching processing, and laser beam machining, for example, to a reflecting layer.

The adhesive layer f1 contains a thereto sensitive adhesive agent so called a hot melt adhesive agent, which exhibits an adhesive property when heated. Examples of a thermo sensitive adhesive agent include well known thermoplastic resins usable for a hot melt adhesive agent such as an acrylic resin, a vinyl chloride-vinyl acetate copolymer, an epoxy resin and an ethylene-vinyl alcohol copolymer. The adhesive layer f1 can be formed by applying an aforementioned resin on a foil layer f2 using a coater, for example, a gravure coater, a micro-gravure coater or a roll coater.

EXAMPLES

Embodiments of the present invention will now be specifically described with the reference to examples, however the present invention is not limited thereto. Incidentally, the expression of "part" referred to in Examples represents "part by mass".

1. Preparation of "Foil Transferring Face Fanning Toners A to N"

Fourteen kinds of "Foil Transferring Face Forming Toners A to N" were prepared via the process of preparation for resin microparticles by multi-step polymerization described above and the process of coagulating and fusing in association method.

1-1. Preparation of "Resin Microparticles A3 to K3"

(1) Preparation of "Resin microparticles A3"

As described later, "Resin microparticles A3" was prepared via polymerization reaction in three steps, namely multi-step polymerization method.

(First Step Polymerization)

In a reaction vessel fitted with a stirrer, a temperature sensor, a cooling pipe, and a nitrogen introducing unit, 4 parts of sodium polyoxyethylene(2)dodecyl ether sulfate was added to 3,000 parts of ion-exchanged water. Liquid temperature was increased to 80° C., while stirring at rotating speed of 230 rpm under nitrogen stream.

After increasing temperature, a polymerization initiator solution prepared by dissolving 4 parts by mass of potassium persulfate (KPS) in 200 parts by mass of ion-exchanged water was added to the aforesaid surface active agent solution. After increasing the liquid temperature to 75° C., a polymerizable monomer solution composed of the compounds described below was dripped over one hour. After dripping the aforesaid polymerizable monomer solution, polymerization reaction underwent while stirred and heated at 75° C. for two hours, whereby dispersion of "Resin Particles Al" was prepared. The weight average molecular weight of formed "Resin Particles Al" determined by the gel permission chromatography method described above was 300,000.

Herein, mixture of monomers comprise compound below:

| | |
|---|---|
| Styrene | 567 parts by mass |
| n-Butyl acrylate | 165 parts by mass |
| Methacrylic acid | 68 parts by mass |

(Second Step Polymerization)

In a reaction vessel fitted with a stirrer, a temperature sensor, a cooling pipe, and a nitrogen introducing unit, 2 parts of sodium polyoxyethylene(2)dodecyl ether sulfate was added to 1,270 parts of ion-exchanged water and temperature was increased to 80° C. Thereafter, 40parts by mass in terms of solids of the aforesaid "Resin Particles A1" and monomer mixture liquid comprising compounds below were placed, by employing a mechanical homogenizer "CLEARMIX, produced by M Technique Co., a mixing and dispersing treatment was carried out over 1 hours and emulsion particle dispersion liquid was prepared.

Herein, mixture of monomers comprise compound below and heating at 80°, WEP-5 was also solved:

| | |
|---|---|
| Styrene | 123 parts by mass |
| n-Butyl acrylate | 45 parts by mass |
| Methacrylic acid | 20 parts by mass |
| n-Octylmercaptan | 0.5 parts by mass |
| WEP-5 (fatty acid ester) | 82 parts by mass |

(Nissan Electol Produced by NOF Corporation)

Subsequently, after increasing temperature, a polymerization initiator solution prepared by dissolving 5 parts by mass of potassium persulfate (KPS) in 100 parts by mass of ion-exchanged water was added to the aforesaid emulsion particle dispersion liquid. After addition, polymerization reaction underwent while stirred and heated at 80° C. for 1 hour, whereby dispersion of "Resin Particles A2" was prepared.

(Third Step Polymerization)

A polymerization initiator solution prepared by dissolving 10 parts by mass of potassium persulfate (KPS) in 200 parts by mass of ion-exchanged water was added to "Resin Particles A2". After increasing the liquid temperature to 80° C., a polymerizable monomer solution composed of the compounds described below was dripped over one hour.

Herein, mixture of monomers comprise compound below:

| | |
|---|---|
| Styrene | 390 parts by mass |
| n-Butyl acrylate | 143 parts by mass |
| Methacrylic acid | 37 parts by mass |
| n-Octylmercaptan | 13 parts by mass |

After dripping the aforesaid polymerizable monomer solution, a polymerization reaction underwent by heating at 80° C. and stirring over two hours. Thereafter, the temperature was lowered to 28° C., whereby "Resin Particles A3" was prepared.

(2) Preparation of "Resin microparticles B3"

In the preparation of "Resin microparticles A3", a content of n-octylmercaptan used in the second step polymerization was changed to 4 parts by mass. Further, content of styrene, n-butylacrylate and methacrylic acid in monomer mixture used in the third step polymerization was changed as follows.

| | |
|---|---|
| Styrene | 428 parts by mass |
| n-Butyl acrylate | 131 parts by mass |
| Methacrylic acid | 11 parts by mass |

As for the rest, "Resin microparticles B3" was prepared in the same manner as the preparation of "Resin microparticles A3".

(3) Preparation of "Resin Microparticles C3"

In the preparation of "Resin microparticles A3", a content of "Resin microparticles A1" used in the second step polymerization was changed to 200 parts by mass in terms of solids. Further, monomer mixture used in the third step polymerization was changed as same as "Resin microparticles B3". As for the rest, "Resin microparticles C3" was prepared in the same manner as the preparation of "Resin microparticles A3".

(4) Preparation of "Resin microparticles D3"

In the preparation of "Resin microparticles A3", a content of n-octylmercaptan used in the second step polymerization was changed to 4 parts by mass. Further, content of styrene, n-butylacrylate and methacrylic acid in monomer mixture used in the third step polymerization was changed as follows.

| | |
|---|---|
| Styrene | 353 parts by mass |
| n-Butyl acrylate | 148 parts by mass |
| Methacrylic acid | 68 parts by mass |

As for the rest, "Resin microparticles D3" was prepared in the same manner as the preparation of "Resin microparticles A3".

(5) Preparation of "Resin Microparticles E3"

In the preparation of "Resin microparticles A3", a content of "Resin microparticles A1" used in the second step polymerization was changed to 200 parts by mass in terms of solids. Further, monomer mixture used in the third step polymerization was changed as same as "Resin microparticles D3". As for the rest, "Resin microparticles E3" was prepared in the same manner as the preparation of "Resin microparticles A3".

(6) Preparation of "Resin Microparticles D3"

In the preparation of "Resin microparticles A3", a content of n-octylmercaptan used in the second step polymerization was changed to 5.5 parts by mass. Further, content of styrene, n-butylacrylate and methacrylic acid in monomer mixture used in the third step polymerization was changed as follows.

| | |
|---|---|
| Styrene | 430 parts by mass |
| n-Butyl acrylate | 131 parts by mass |
| Methacrylic acid | 7 parts by mass |

As for the rest, "Resin microparticles F3" was prepared in the same manner as the preparation of "Resin microparticles A3".

(7) Preparation of "Resin Microparticles G3"

In the preparation of "Resin microparticles A3", a content of "Resin microparticles A1" was changed to 200 parts by mass in terms of solids and content of n-octylmercaptan used in the second step polymerization was changed to 0.2 parts by mass. Further, monomer mixture used in the third step polymerization was changed as same as "Resin microparticles F3". As for the rest, "Resin microparticles G3" was prepared in the same manner as the preparation of "Resin microparticles A3".

(8) Preparation of "Resin Microparticles H3"

In the preparation of "Resin microparticles A3", a content of n-octylmercaptan used in the second step polymerization was changed to 5.5 parts by mass. Further, content of styrene, n-butylacrylate and methacrylic acid in monomer mixture used in the third step polymerization was changed as follows.

| | |
|---|---|
| Styrene | 331 parts by mass |
| n-Butyl acrylate | 154 parts by mass |
| Methacrylic acid | 86 parts by mass |

As for the rest, "Resin microparticles H3" was prepared in the same manner as the preparation of "Resin microparticles A3".

(9) Preparation of "Resin microparticles I3"

In the preparation of "Resin microparticles A3", a content of "Resin microparticles A1" was changed to 200 parts by mass in terms of solids and content of n-octylmercaptan used in the second step polymerization was changed to 0.2 parts by mass. Further, monomer mixture used in the third step polymerization was changed as same as "Resin microparticles H3". As for the rest, "Resin microparticles I3" was prepared in the same manner as the preparation of "Resin microparticles A3".

(10) Preparation of "Resin Microparticles J3"

In the preparation of "Resin microparticles A3", an initiator solution used in the second step polymerization was changed to a solution prepared by dissolving 2 parts by mass of potassium persulfate (KPS) in 200 parts by mass of ion-exchanged water. After dripping the aforesaid polymerizable monomer solution, polymerization reaction underwent for 2.5 hours, whereby "Resin microparticles J1" was prepared. The weight average molecular weight of formed "Resin microparticles J1" determined by the gel permission chromatography method described above was 400,000. "Resin microparticles J3" was prepared by the second step polymerization and the third step polymerization in the same manner as the preparation of "Resin microparticles A3" except for using "Resin microparticles J1".

(11) Preparation of "Resin Microparticles K3"

In the preparation of "Resin microparticles A3", an initiator solution used in the second step polymerization was changed to a solution prepared by dissolving 10 parts by mass of potassium persulfate (KPS) in 200 parts by mass of ion-exchanged water. After dripping the aforesaid polymerizable monomer solution, polymerization reaction underwent for 1.5 hours, whereby "Resin microparticles K1" was prepared. The weight average molecular weight of formed "Resin microparticles J1" determined by the gel permission chromatography method described above was 200,000. "Resin microparticles K3" was prepared by the second step polymerization and the third step polymerization in the same manner as the preparation of "Resin microparticles A3" except for using "Resin microparticles K1" and changing a content of n-octylmercaptan to 4.0 parts by mass.

1-2. Preparation of "Foil Transferring Face Forming Toners A to K"

(1) Preparation of "Foil Transferring Face Forming Toner A"

(Aggregation and Fusion Process)

Into a reaction vessel fitted with a stirrer, a temperature sensor, a cooling pipe, and a nitrogen introducing unit, placed were:

| | |
|---|---|
| "Resin microparticles A3" | 450 parts by mass (in terms of solids) |
| Ion-exchanged water | 1,100 parts by mass |
| Sodium dodecyl sulfate | 2 parts by mass |

After regulating the interior to 30° C. while stirring, the pH was regulated to 10 by the addition of a 5 mol/liter aqueous potassium hydroxide solution.

Subsequently, an aqueous solution, prepared by dissolving 60 parts by mass of magnesium chloride hexahydrate in 60 parts by mass of ion-exchanged water, was added at 30° C. while stirred over 10 minutes. After the addition, the resulting mixture was allowed to stand for three minutes, followed by further heating. The temperature of the above system was increased to 85° C. over 60 minutes. Keeping at 85° C., above aggregation and fusion process was continued. Subsequently, the average diameter of aggregated particles was determined via "COULTER MULTISIZER 3 (produced by Beckmann Coulter Co.), and when the volume based median diameter reached 6.7 μm, an aqueous solution prepared by dissolving 200 parts by mass of sodium chloride in 860 parts by mass of ion-exchanged water was added, and particle growth was terminated After terminating aggregation, as a ripening treatment, the liquid temperature was regulated to 95° C., and fusion between "Resin microparticles A3" was allowed to continue via heating and stirring over 8 hours, whereby "Toner mother particle A" was prepared. After ripening treatment, the liquid temperature was cooled to 30° C., and pH of liquid was regulated to 2 and stop stirring.

Above prepared "Toner mother particle A" was solid-liquid separated by using basket type centrifuge "MARK III, type 60×40 (produced by Matsumoto Machine Mfg. Co., Ltd.)", whereby a wet cake of "Toner mother particle A" was prepared. The wet cake was washed with ion-exchanged water at 40° C. by using the basket type centrifuge above until an electric conductivity of filtrate reached to 5 μS/cm. After the washing process, drying was carried out by "Flash Jet Dryer (produced by Seishin Enterprise Co., Ltd)" to the water content of 0.5% by mass, whereby "Toner mother particle A" was prepared.

(External Addition Process)

Following external additives were added to 100 parts by mass of prepared "Toner mother particle A", whereby "Foil transferring face forming toner A" was prepared by employing a Henschel mixer (produced by Mitsui Miike Mining Co., Ltd.).

| | |
|---|---|
| Hexamethylsilazane-treated silica (average primary particle diameter of 12 nm, hydrophobized degree of 68) | 1.0 part by mass and |
| n-octylsilane-treated titanium dioxide (average primary particle diameter of 20 nm, hydrophobized degree of 63) | 0.3 part by mass. |

External addition processes were carried out in such a manner that by employing a Henschel mixer, mixing was performed under conditions of a stirring blade peripheral rate of 35 m/second, a processing temperature of 35° C., and a processing period of 15 minutes.

"Foil Transferring Face Forming Toner A" was prepared by employing above procedure. Prepared "Toner A for forming a foil transferring face" had a volumetric basis median size of 6.7 μm, the softening temperature by the method described above of 120° C., and a ratio of a molecular weight of not less than 60,000 being 20%.

(2) Preparation of "Foil Transferring Face Forming Toners B to K"

"Foil Transferring Face Forming Toners B to K" were prepared in the same manner as "Foil Transferring Face Forming Toner A" except for using "Resin microparticles B3 to K3" instead of using "Resin microparticles A3". Prepared "Foil Transferring Face Forming Toners B to K" each had a volume based median diameter of 6.7 μm. The softening temperature by the method described above and a ratio of a molecular weight of not less than 60,000 for each toner were as follows.

"Foil Transferring Face Forming Toner B" had the softening temperature of 105° C. and a ratio of a molecular weight of not less than 60,000 being 10%. "Foil Transferring Face Forming Toner C" had the softening temperature of 110° C. and a ratio of a molecular weight of not less than 60,000 being 30%. "Foil Transferring Face Forming Toner D" had the softening temperature of 138° C. and a ratio of a molecular weight of not less than 60,000 being 10%. "Foil Transferring Face Forming Toner E" had the softening temperature of 140° C. and a ratio of a molecular weight of not less than 60,000 being 30%.

"Foil Transferring Face Forming Toner F" had the softening temperature of 98° C. and a ratio of a molecular weight of not less than 60,000 being 7.5%. "Foil Transferring Face Forming Toner G" had the softening temperature of 100° C. and a ratio of a molecular weight of not less than 60,000 being 35%. "Foil Transferring Face Forming Toner H" had the softening temperature of 145° C. and a ratio of a molecular weight of not less than 60,000 being 7.5%. "Foil Transferring Face Forming Toner I" had the softening temperature of 145° C. and a ratio of a molecular weight of not less than 60,000 being 35%. "Foil Transferring Face Forming Toner J" had the softening temperature of 125° C. and a ratio of a molecular weight of not less than 60,000 being 22%. "Foil Transferring Face Forming Toner K" had the softening temperature of 115° C. and a ratio of a molecular weight of not less than 60,000 being 4%.

(3) Preparation of "Foil Transferring Face Forming Toners L, M and N"

"Foil Transferring Face Forming Toner L" was prepared in the same manner as "Foil Transferring Face Forming Toner A" except for using an aqueous solution, prepared by dissolving 75 parts by mass of magnesium chloride hexahydrate in 60 parts by mass of ion-exchanged water, in aggregating and fusing "Resin microparticles A3". "Foil Transferring Face Forming Toner M" was prepared in the same manner as "Toner A for forming a foil transferring face" except for using an aqueous solution, prepared by dissolving 45 parts by mass of magnesium chloride hexahydrate in 60 parts by mass of ion-exchanged water, in aggregating and fusing "Resin microparticles A3".

Further, "Foil Transferring Face Forming Toner N" was prepared in the same manner as "Foil Transferring Face Forming Toner J" except for using an aqueous solution, prepared by dissolving 45 parts by mass of magnesium chloride hexahydrate in 60 parts by mass of ion-exchanged water, in aggregating and fusing "Resin microparticles J3" having a weight average molecular weight of 75,000.

A volumetric basis median size of "Foil Transferring Face Forming Toners L, M and N" each was 6.7 μm. A ratio of a molecular weight of not less than 60,000 determined by the method described above of "Foil Transferring Face Forming Toners L and M" each was 20% and that of "Foil Transferring Face Forming Toner N" was 22%. A softening temperature determined by the method described above for "Foil Transferring Face Forming Toner L" was 130° C., for "Foil Transferring Face Forming Toner M" was 110° C. and for "Foil Transferring Face Forming Toner N" was 115° C.

Softening temperature, ratio of a molecular weight of not less than 60,000 and kinds of resin microparticles used for preparing "Foil Transferring Face Forming Toners A to N" were listed in Table 1 below.

TABLE 1

| Toner No. | Raw resin particles | Softening temperature (° C.) | Ratio of molecule having molecular weight of 60,000 or more (%) |
|---|---|---|---|
| A | A3 | 120 | 20 |
| B | B3 | 105 | 10 |
| C | C3 | 110 | 30 |
| D | D3 | 138 | 10 |
| E | E3 | 140 | 30 |
| F | F3 | 98 | 7.5 |
| G | G3 | 100 | 35 |
| H | H3 | 145 | 7.5 |
| I | I3 | 145 | 35 |
| J | J3 | 125 | 22 |
| K | K3 | 115 | 4 |
| L | A3 | 130 | 20 |
| M | A3 | 110 | 20 |
| N | J3 | 115 | 22 |

2. Evaluation 2-1. Preparation of "Foil Transferring Face Forming Toner Developers A to N"

By using V-shaped mixing machine, ferrite carriers covered with silicone resin having a volume average diameter of 60 μm were added to above "Foil Transferring Face Forming Toners A to N"", whereby prepared were "Foil Transferring Face Forming Toner Developers A to N" as two component developer having toner content of 6% by mass.

2-2. Evaluation (1) Conditions for Evaluation

Figure 6:
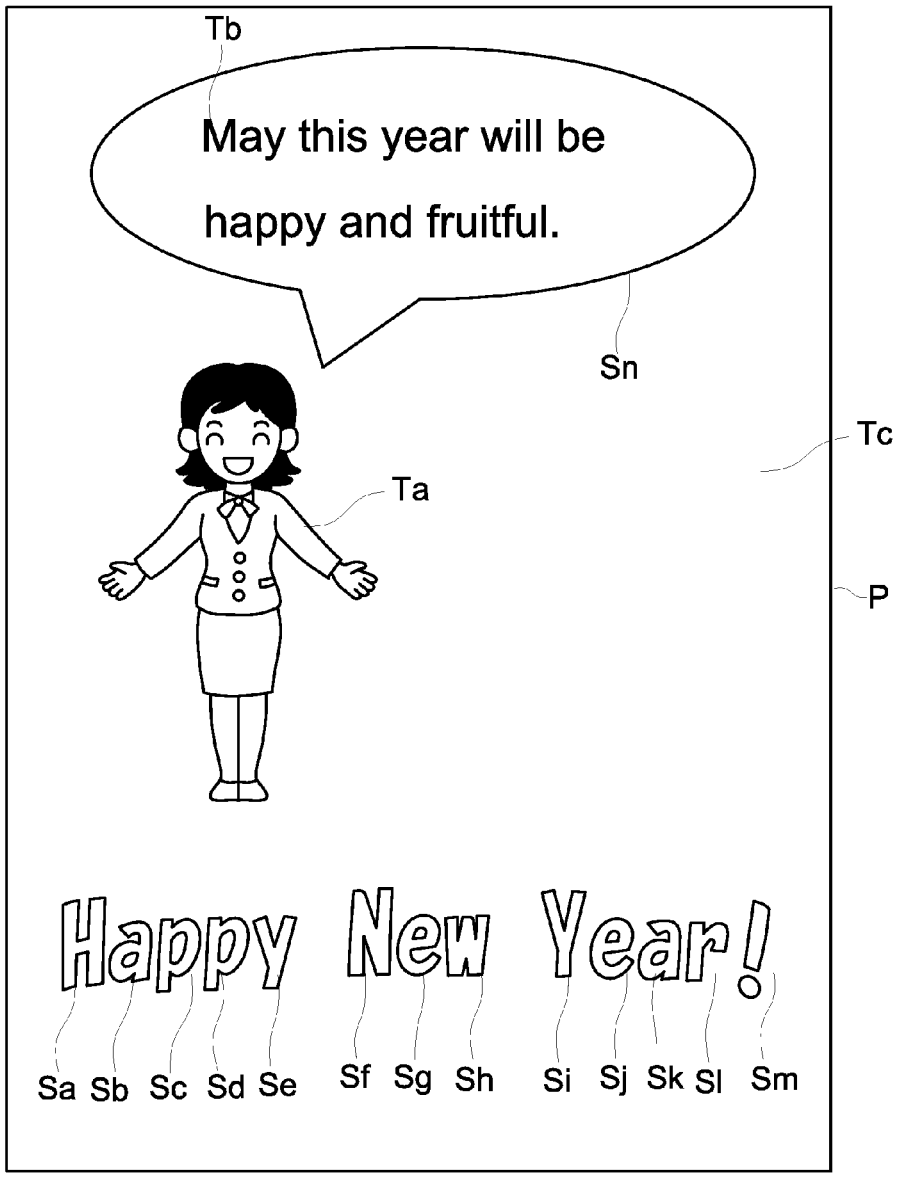
FIG. 6 is a schematic diagram of a foil image and a printed matter for evaluation having a toner image which is formed in Examples.

"Foil Transferring Face Forming Toner Developers A to N" were evaluated by forming printed matter having design of a foil image S and a toner image T shown in FIG. 6. Herein, "Examples 1 to 9" were carried out by using "Foil Transferring Face Forming Toners A to E, J, L, M and N", and "Comparative examples 1 to 5" were carried out by using "Foil Transferring Face Forming Toners F to I and K". Three hundreds prints for forming a foil transferring face were continuously printed by using each toner.

The printing for evaluation was carried out using a modified digital image forming apparatus "bizhub PRO C6500 (produced by Konica Minolta Business Technologies, Inc.)" incorporating the Foil transferring face formation device 1 shown in FIG. 3, while toner supply apparatus 21H for forming a foil transferring face was installed. As for an image support P on which a foil image and toner image were formed, used was a commercially available B4 size image support "OK Top Coat+(basis weight of 157 g/m$^2$, thickness of 131 μm) (produced by Oji Paper)". Toner supply amount for forming a foil transferring face was set to 4 g/m$^2$ to form a foil transferring face.

In fixing unit 50, fixing speed was set to 230 mm/sec., surface material of heat roller was set to polytetrafluoroethylene (PTFE), and surface temperature of the heat roller was set at 135° C.

After forming a foil transferring face by using a foil transferring face forming toner on the image support P via the image forming apparatus, according to the procedures shown in FIG. 1, a foil was transferred onto the foil transferring face on the image support by using commercially available transfer foil having layer construction shown in FIG. 5. "BL No. 2 Gold 2.8" produced by Murata Kinpaku Co., Ltd) was used as a transfer foil.

Foil transfer according to the procedure shown in FIG. 1 was carried out under following conditions:

Heating roll: Silicon rubber layer of 3 mm thickness was arranged on aluminum base with outer diameter of 100 mm and thickness of 10 mm. Surface temperature was set at 150° C., Pressure roll: Silicon rubber layer of 3 mm thickness was arranged on aluminum base with outer diameter of 80 mm and thickness of 10 mm. Surface temperature was set at 100° C., Heat source: Halogen lump was arranged inside of the heat roll and pressure roll each and temperature was controlled by using thermistor, Nip width between heating roll and pressure roll: 7 mm, Conveying speed of image support: 100 mm/second, Direction of conveying image support: B4 size image support was conveyed in a longitudinal direction, Ambient conditions for evaluation: at normal temperature and normal humidity (20° C., 50% RH.).

(2) Evaluation Image

FIG. 6 shows an image formed on image support P. Foil image S comprises eleven text images Sa to Sn represented by "Happy New Year!" and image of balloon Sn arranged over a figure. After forming above foil images, toner image T was formed on image support P via toner image forming unit 20 in the foil transferring face formation device 1 shown in FIG. 3. Formed toner image T comprises a figure image Ta, a text image Tb in a balloon represented by "May this year will be happy and fruitful", and a background image Tc with light monochrome image having a reflection density of 0.1.

(3) Evaluation Items

For one kind of foil transferring face forming toner, 300 sheets were continuously printed. Ten printed matter were arbitrarily selected among 300 printed matter and evaluated were with or without of occurring stripe on the formed foil transferring face and with or without of falling off of transfer foil. Further, evaluated were transfer property of toner image on the foil image and conveying property in continuous printing.

(Stripe)

Thirteen texts foil image Sa to Sn on the selected 10 printed matter were observed visually by employing a loupe having a magnification of 10 times and stripe were evaluated by classifying according to the following evaluation ranks and by counting a number of printed matters in each rank.

Rank A: Stripe was not observed in all 13 text foil images by both megascopic inspection and inspection employing a loupe, Rank B: Stripe was not observed in all 13 text foil images by megascopic inspection, however a slight stripe was observed in 1 to 2 texts by inspection employing a loupe, Rank C: Stripe was not observed in all 13 text foil images by megascopic inspection, however a slight stripe was observed in 3to 6 texts by inspection employing a loupe, Rank D: Stripe was not observed in all 13 text foil images by megascopic inspection, however a slight stripe was observed in 7 or more texts by inspection employing a loupe, Rank E: Stripe was observed in 1 or more texts by megascopic inspection.

Based on above ranks, evaluation was carried out according to criteria below:

Excellent: All of 10 printed matters were in Rank A and Rank B,

Good: Of 10 printed matter, 1 to 3 were in Rank C, the rest were in Rank A and Rank B, Passed: Of 10 printed matter, 4 or more were in Rank C, the rest were in Rank A and Rank B, Failed: Of 10 printed matter, at ease 1 was in Rank D or Rank D.

(Transfer Property of Toner Image on the Foil Image)

As to the selected 10 printed matter, text image Tb formed by toner on the foil image in balloon Sn were observed visually by employing a loupe having a magnification of 10 times and finished appearances were evaluated by classifying according to the following evaluation ranks and by counting a number of printed matters in each rank.

Rank A: Precise transfer of text image was observed by both megascopic inspection and inspection employing a loupe, Rank B: Nonproblematic finish was observed by megascopic inspection, however a slight partial defect was observed by inspection employing a loupe, Rank C: Partial defect was observed in toner image by megascopic inspection.

Based on above ranks, evaluation was carried out according to criteria below:

Excellent: All of 10 printed matters were in Rank A,

Good: Of 10 printed matter, 5 or less were in Rank B, the rest were in Rank A,

Passed: Of 10 printed matter, 6 to 10 were in Rank B, the rest were in Rank A,

Failed: Of 10 printed matter, at east 1 was in Rank C.

(Anti-peeling Property)

On the texts foil image Sf (at the text of "N") on the selected 10 printed matter, a sticking tape was adhered and then peeled by hand. The condition of each foil image was observed visually and employing a loupe having a magnification of 10 times, and evaluated according to the following criteria In this evaluation, "Scotch mending tape MP-18 (produced by SUMITOMO 3M, Limited)." was used.

A No minute peeling observable with the loupe having a magnification of 10 times was found, B Minute peeling observable by the loupe having a magnification of 10 times was found, however, it was judge to be non-problematic by visual observation, and C Peeling which was visually observable was found.

Based on above ranks, evaluation was carried out according to criteria below:

Excellent: All of 10 printed matters were in A,

Good: Of 10 printed matter, 5 or less were in B, the rest were in A,

Passed: Of 10 printed matter, 6 to 10 were in B, the rest were in A,

Failed: Of 10 printed matter, at east 1 was in C.

(Evaluation of Conveying Property)

Three points below were evaluated during continuously printing 300 sheets:

A: Formed printed matter were discharged to document discharging tray 90 within the predetermined interval, B: Two prints were not discharged from the apparatus in overlapped state, and C: No unexpected convey noise were noticed.

Printed matters conveyed without any trouble in above A to C were decided to be passed:

Results were listed in Table 2.

TABLE 2

| | Toner | Stripe Evaluation | | | | | | Toner Image Transferring property | | | | | Anti-peeling | | | | Conveying property | | |
|---|---|---|---|---|---|---|---|---|---|---|---|---|---|---|---|---|---|---|---|
| | No. | Judge | Rank A | Rank B | Rank C | Rank D | Rank E | Judge | Rank A | Rank B | Rank C | Judge | A | B | C | *1 | Overlap | *2 |
| Inv. 1 | A | Excellent | 10 | 0 | 0 | 0 | 0 | Excellent | 10 | 0 | 0 | Excellent | 10 | 0 | 0 | OK | None | None |
| Inv. 2 | B | Good | 2 | 5 | 3 | 0 | 0 | Good | 4 | 6 | 0 | Excellent | 10 | 0 | 0 | OK | None | None |
| Inv. 3 | C | Excellent | 7 | 3 | 0 | 0 | 0 | Excellent | 9 | 1 | 0 | Excellent | 10 | 0 | 0 | OK | None | None |
| Inv. 4 | D | Passed | 0 | 4 | 6 | 0 | 0 | Passed | 3 | 7 | 0 | Good | 5 | 5 | 0 | OK | None | None |
| Inv. 5 | E | Excellent | 7 | 3 | 0 | 0 | 0 | Good | 5 | 5 | 0 | Passed | 3 | 7 | 0 | OK | None | None |
| Inv. 6 | J | Excellent | 9 | 1 | 0 | 0 | 0 | Excellent | 8 | 2 | 0 | Good | 6 | 4 | 0 | OK | None | None |
| Inv. 7 | L | Excellent | 8 | 2 | 0 | 0 | 0 | Excellent | 7 | 3 | 0 | Good | 6 | 4 | 0 | OK | None | None |
| Inv. 8 | M | Excellent | 8 | 2 | 0 | 0 | 0 | Excellent | 7 | 3 | 0 | Excellent | 10 | 0 | 0 | OK | None | None |
| Inv. 9 | N | Excellent | 10 | 0 | 0 | 0 | 0 | Excellent | 10 | 0 | 0 | Excellent | 10 | 0 | 0 | OK | None | None |
| Comp. 1 | F | Failed | 0 | 0 | 1 | 4 | 5 | Failed | 2 | 3 | 5 | Passed | 4 | 6 | 0 | OK | None | None |
| Comp. 2 | G | Failed | — | — | — | — | — | Failed | — | — | — | Failed | — | — | — | NG | Occur | Occur |
| Comp. 3 | H | Failed | 0 | 0 | 1 | 5 | 4 | Failed | 1 | 2 | 7 | Failed | 0 | 7 | 3 | OK | None | None |
| Comp. 4 | I | Failed | — | — | — | — | — | Failed | — | — | — | Failed | — | — | — | NG | Occur | Occur |
| Comp. 5 | K | Failed | 0 | 0 | 0 | 2 | 8 | Failed | 0 | 1 | 9 | Excellent | 10 | 0 | 0 | OK | None | None |

*1: Predetermined interval
*2: Unexpected noise
Inv.: Inventive Example
Comp.: Comparative Example As shown in Table 2, each of "Examples 1 to 9", in which printed matter was formed by using the foil transferring face forming toner having the constitutions of the present invention, did not cause stripe on the foil, even when toner image was formed on the image support transferred by foil and heated for fixation. Further, it was confirmed that the toner image can be precisely transferred on the foil image and the foil image having excellent strength without decreasing adhesive force between a foil transferring face and the foil, even heated in a state having transferred foil. Further, confirmed was the stable conveying property in case of continuous printing. On the other hand, among "Comparative examples 1 to 5" in which printed matter was formed by using the toner for forming foil transferring face without satisfying the constitution of the present invention, in case of "Comparative examples 2 and 4", the foil transferring face unable to be formed due to higher ratio of a molecular weight of not less than 60,000 in the resin for constituting the toner. Further, in case of "Comparative examples 1, 3 and 5", the stripe occurred on the foil image by deformation of foil transferring face by heating.

| Description of the Alphanumeric Designations | |
|---|---|
| 1 | Foil transferring face formation device |
| 11 (11H, 11Y, 11M, 11C, 11Bk) | Photoreceptor |
| 12 (12H, 12Y, 12M, 12C, 12Bk) | Charging roller, Charging electrode |
| 13 (13A, 13H, 13Y, 13M, 13C, 13Bk) | Transferring roller |
| 14 | Toner supply roller |
| 20H | Foil transferring face forming section |
| 20Y, 20M, 20C, 20Bk | Toner image forming section |
| 21H | Device for supplying foil transferring face forming toner |
| 21Y, 21M, 21C, 21Bk | Toner supply (Developing device) |
| 23 | Conveying roller |
| 25 (25H, 25Y, 25M, 25C, 25Bk) | Cleaning device |
| 26 | Intermediate transfer belt |
| 30 (30H, 30Y, 30M, 30C, 30Bk) | Exposing section |
| 50 | Fixing device |
| 51 | Supply path for transfer foil |
| 60 | Image reading section |
| 70 | Supply section for transfer foil |
| 71 | Transfer foil supply roller |
| 72 | Transfer foil winding roller |
| 73a, 73b | Transfer foil transferring roller |
| F | Transfer foil |
| f0 | Support |
| f1 | Adhesive layer |
| f2 | Foil layer |
| f3 | Releasing layer |
| H | Foil transferring face |
| P | Support (Image support) |
| Q | Product |
| R1, R2 | Heat and pressure roll |
| S | Foil image |
| Sa, Sb, Sc, Sd, Se | Text foil image |
| Sf, Sg, Sh | Text foil image |
| Si, Sj, Sk, Sl, Sm | Text foil image |
| Sn | Balloon foil image |

-continued

| Description of the Alphanumeric Designations | |
|---|---|
| Ta | Figure toner image |
| Tb | Text toner image |
| Tc | Background toner image |

What is claimed is:

1. A method for forming an image comprising steps of:

forming an electrostatic latent image by exposing an electrophotographic photoreceptor, forming a foil transferring face by supplying a toner onto the electrophotographic photoreceptor having the electrostatic latent image, transferring the foil transferring face formed on the electrophotographic photoreceptor onto a base substance, fixing the foil transferring face transferred on the base substance, supplying a transfer foil to the base substance having the fixed foil transferring face, adhering the transfer foil onto the foil transferring face by heating under a condition of contacting the transfer foil with the foil transferring face;

removing the transfer foil, from the base substance while leaving the foil adhered onto the foil transferring face, and heating the base substance having the transferred foil on the foil transferring face, wherein a toner which is used to form the foil transferring face comprises a binder resin having a softening temperature in the range of from not less than 105 ° C to not more than 140 ° C determined by a Flow tester method, and having a molecular weight of not less than 60,000 in a ratio of not less than 10% and not more than 30% based on the total binder resin constituting the toner determined by a gel permission chromatography method.

2. The method. for forming an image of claim 1 comprising steps of:

forming a toner image onto the base substance having the transferred foil on the foil transferring face, and fixing the toner image by heating the base substance having the toner image.

3. The method for forming an image of claim 1, wherein the binder resin at least comprises a copolymer formed by polymerizing monomers of styrene, n-butyl acrylate and methacrylic acid.

4. The method for forming an image of claim 1, wherein the binder resin at least comprises a copolymer formed by polymerizing monomers of styrene, n-butyl acrylate and methacrylic acid.

5. The method for forming an image of claim 2, wherein the binder resin at least comprises a copolymer formed by polymerizing monomers of styrene, n-butyl acrylate and methacrylic acid.

* * * * *